US009596044B2

(12) United States Patent
Nekhamkin et al.

(10) Patent No.: US 9,596,044 B2
(45) Date of Patent: Mar. 14, 2017

(54) METHOD AND APPARATUS FOR ANALOG AND DIGITAL AUDIO BLEND FOR HD RADIO RECEIVERS

(71) Applicant: iBiquity Digital Corporation, Columbia, MD (US)

(72) Inventors: Michael Nekhamkin, Bridgewater, NJ (US); Andrej Domazetovic, Novi Sad (RS); Raymond Yen, South Plainfield, NJ (US); Sivakumar Thulasingam, Piscataway, NJ (US)

(73) Assignee: iBiquity Digital Corporation, Columbia, MD (US)

( * ) Notice: Subject to any disclaimer, the term of this patent is extended or adjusted under 35 U.S.C. 154(b) by 50 days.

(21) Appl. No.: 14/622,260

(22) Filed: Feb. 13, 2015

(65) Prior Publication Data

US 2016/0241350 A1 Aug. 18, 2016

(51) Int. Cl.

| | |
|---|---|
| ***H04H 40/00*** | (2009.01) |
| ***H04H 20/88*** | (2008.01) |
| ***H04H 20/26*** | (2008.01) |
| ***G10L 19/00*** | (2013.01) |
| ***G10L 21/04*** | (2013.01) |

(52) U.S. Cl.

CPC ..... *H04H 20/88* (2013.01); *G10L 19/0019* (2013.01); *G10L 21/04* (2013.01); *H04H 20/26* (2013.01); *H04H 2201/18* (2013.01)

(58) Field of Classification Search

None

See application file for complete search history.

(56) References Cited

U.S. PATENT DOCUMENTS

| | | | | |
|---|---|---|---|---|
| 8,520,852 | B2 | 8/2013 | Shah et al. | |
| 2010/0027719 | A1 | 2/2010 | Pahuja | |
| 2012/0028567 | A1* | 2/2012 | Marko | H04W 4/206 455/3.02 |
| 2013/0343576 | A1* | 12/2013 | Pahuja | H04H 40/36 381/119 |
| 2014/0270252 | A1 | 9/2014 | Pahuja et al. | |

OTHER PUBLICATIONS

International Search Report and Written Opinion for PCT Application No. PCT/US2016/017322 mailed May 17, 2016.

Ibiquity Digital HD Radio, HD Radio(TM) Air Interface Design Description Audio Transport, Rev. F, Dec. 6, 2007.

* cited by examiner

*Primary Examiner* — Mohammed Rachedine

(74) *Attorney, Agent, or Firm* — Terrile, Cannatti, Chambers & Holland LLP; Michael Rocco Cannatti

(57) ABSTRACT

A method and apparatus are provided for blending analog and digital portions of a composite digital radio broadcast signal by processing compressed audio packets to compute corresponding digital audio quality indicator values, storing the compressed audio packets in an audio blend buffer, processing audio information from each compressed audio packet stored in the audio blend buffer with an audio decoder to generate decompressed digital audio signal samples, and using the digital audio quality indicator values to guide a blending process for combining analog audio signal samples with the digital audio signal samples to produce an audio output by preventing unnecessary blending back and forth between analog and digital if the digital audio quality indicator values indicate that the compressed audio packets are degraded or impaired.

20 Claims, 14 Drawing Sheets

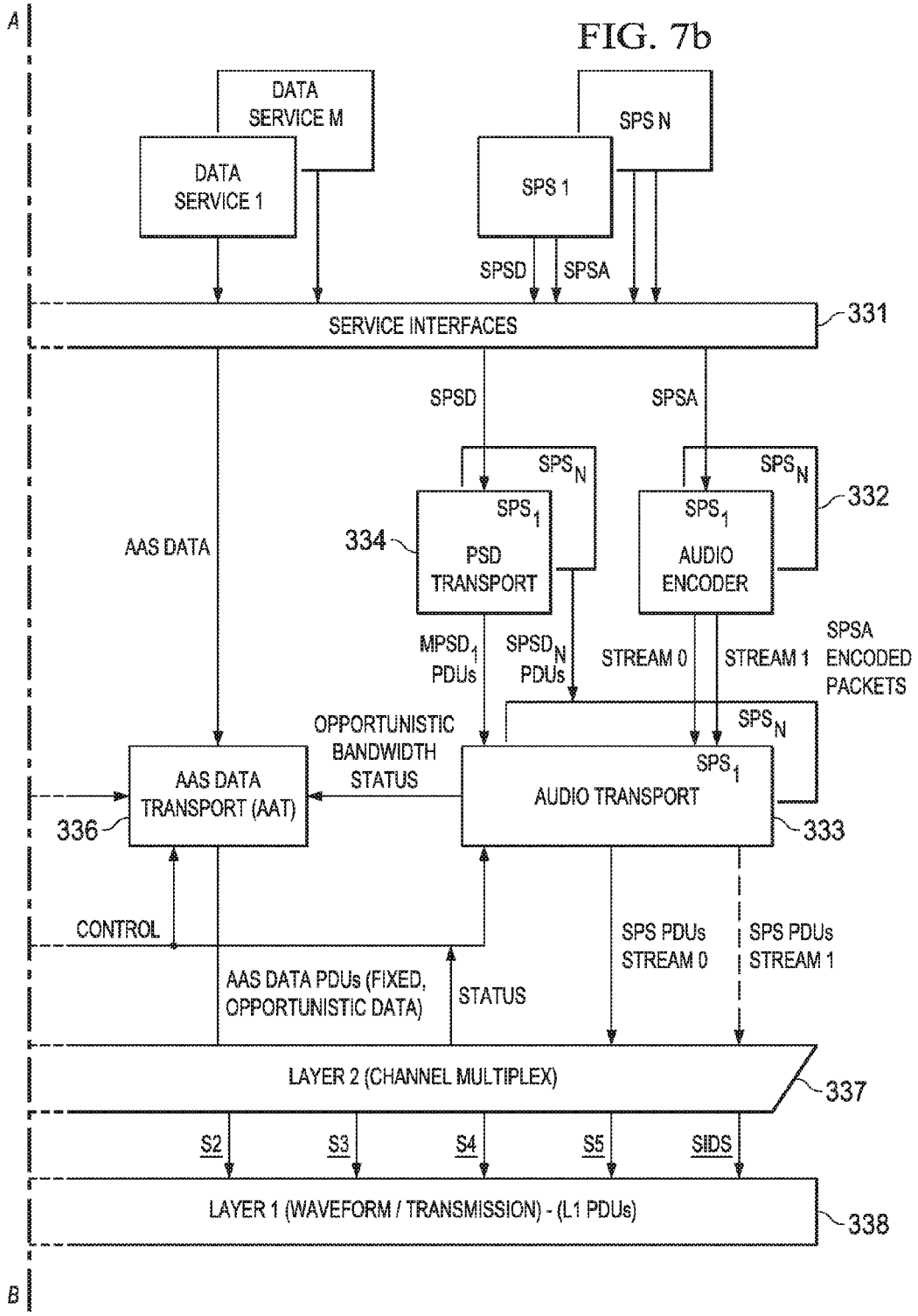
A
FIG. 7b
DATA SERVICE M
DATA SERVICE 1
SPS N
SPS 1
SPSD
SPSA
SERVICE INTERFACES
331
SPSD
SPSA
SPS$_N$
SPS$_1$
PSD TRANSPORT
334
SPS$_N$
SPS$_1$
AUDIO ENCODER
332
AAS DATA
MPSD$_1$ PDUs
SPSD$_N$ PDUs
STREAM 0
STREAM 1
SPSA ENCODED PACKETS
OPPORTUNISTIC BANDWIDTH STATUS
SPS$_N$
SPS$_1$
AAS DATA TRANSPORT (AAT)
336
AUDIO TRANSPORT
333
CONTROL
AAS DATA PDUs (FIXED, OPPORTUNISTIC DATA)
STATUS
SPS PDUs STREAM 0
SPS PDUs STREAM 1
LAYER 2 (CHANNEL MULTIPLEX)
337
S2
S3
S4
S5
SIDS
LAYER 1 (WAVEFORM / TRANSMISSION) - (L1 PDUs)
338
B

METHOD AND APPARATUS FOR ANALOG AND DIGITAL AUDIO BLEND FOR HD RADIO RECEIVERS

BACKGROUND OF THE INVENTION

Field of the Invention

The present invention is directed in general to digital radio broadcast transmitters and receivers and methods for operating them. In one aspect, the present invention relates to methods and apparatus for blending digital and analog portions of an audio signal in a radio receiver.

Description of the Related Art

Digital radio broadcasting technology delivers digital audio and data services to mobile, portable, and fixed receivers using existing radio bands. One type of digital radio broadcasting, referred to as in-band on-channel (IBOC) digital radio broadcasting, transmits digital radio and analog radio broadcast signals simultaneously on the same frequency using digitally modulated subcarriers or sidebands to multiplex digital information on an AM or FM analog modulated carrier signal. HD Radio™ technology, developed by iBiquity Digital Corporation, is one example of an IBOC implementation for digital radio broadcasting and reception. With IBOC digital radio broadcasting, the audio signal can be redundantly transmitted on the analog modulated carrier and the digitally modulated subcarriers by transmitting the analog audio AM or FM backup audio signal (which is delayed by the diversity delay) so that the analog AM or FM backup audio signal can be fed to the audio output when the digital audio signal is absent, unavailable, or degraded. In these situations, the analog audio signal is gradually blended into the output audio signal by attenuating the digital signal such that the audio is fully blended to analog as the digital signal becomes unavailable. Similar blending of the digital signal into the output audio signal occurs as the digital signal becomes available by attenuating the analog signal such that the audio is fully blended to digital as the digital signal become available. However, due to limitations in the smoothness of the blending function, blend transitions between analog and digital signals can degrade the listening experience when the audio differences between the analog and digital signals are significant. For example, at the edge of a station coverage where the signal is changing around the minimum required level, squawk-like interference can occur when the signal is briefly under the required level, in which case the decoder fails to generate real audio, and instead sends out meaningless data. In most cases, this trash data tends to fluctuate to the maximum amplitude, thereby creating a sudden, short-period and uncomfortable squawk-like pop noise. Existing solutions to smooth the blending function require large audio packets buffers for storing decoded audio packets, adding cost and increased on-chip memory requirements for the receivers. Other solutions aim at reducing the frequency of blends by using computed estimated signal-to-noise values in the blending decision, but such estimated values have limited accuracy with certain conditions, such as with channels having interference or a moving automobile where there is selective fading channel experience in the mobile environment. Because of at least the demonstrated challenges for blending digital and analog signals at a radio receiver without noticeably impairing the listening experience, it would be desirable to have a more practical and cost effective solution for processing the digital audio.

BRIEF DESCRIPTION OF THE DRAWINGS

The present invention may be understood, and its numerous objects, features and advantages obtained, when the following detailed description is considered in conjunction with the following drawings, in which:

FIGS. 7*a* and 7*b* are diagrams of an IBOC digital radio broadcasting logical protocol stack from the broadcast perspective;

DETAILED DESCRIPTION

Figure 1:
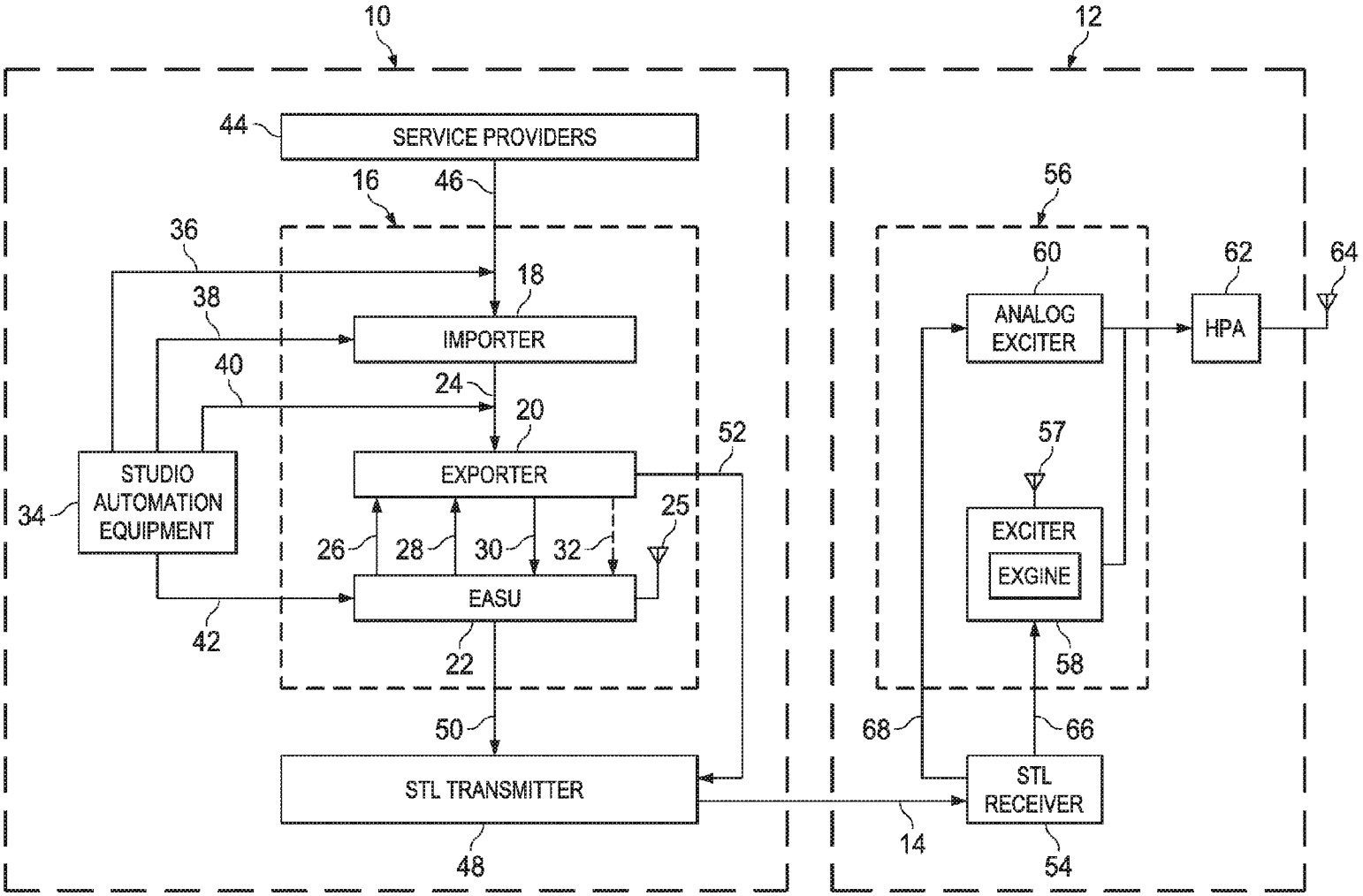
FIG. 1 illustrates a simplified block diagram of a transmitter for use in an in-band on-channel digital radio broadcasting system in accordance with certain embodiments.

A digital radio receiver apparatus and associated methods for operating same are described for efficiently blending digital and analog signals by buffering compressed audio packets in an input buffer to an audio decoder and computing estimated digital audio quality indicators (QI) from the compressed audio packets stored in the input buffer to guide the blending of the analog and digital signals. Instead of buffering PCM audio samples from the audio decoder in an output audio blend buffer to be used for combination in an audio transition or blending module, the storage of compressed audio packets in an input audio blend buffer enables a smaller sized input audio blend buffer to be used. In selected embodiments, the input audio blend buffer may be sized as an M entry buffer for storing compressed audio packets corresponding to a specified duration of audio that is sufficient to ensure smooth transition between analog and digital audio. For example, to store 1 second of audio at 96 kB/s, the input audio blend buffer requires only 12 kB of memory. In selected embodiments, the digital audio quality information is extracted by performing audio quality estimation on the compressed audio packets that are entering an input compressed audio blend buffer so that, when the input compressed audio blend buffer is completely filled, the receiver's blend decision function module can determine if the content of the input compressed audio blend buffer is distorted or not when controlling the blending of digital and analog signals. Improved blending performance can be obtained by performing audio quality estimation at the input of the compressed audio packet buffer instead of performing audio quality estimation at the input of compressed audio blend buffer. The compressed audio packet buffer may contain K packets which may be used for delaying digital audio to align it in time domain with the analog audio and/or for aligning audio packets between core and enhanced audio streams. By performing audio quality estimation on compressed audio packets as they enter the compressed audio packet buffer, the estimated digital audio quality information may be stored or otherwise used to effectively provide the blend decision function module with advance or a priori knowledge or look ahead metrics for when the digital signal quality goes bad. With this advance knowledge, the digital radio receiver may continue using the analog signal and refrain from blending back to digital if the estimated digital audio quality information indicates that the digital signal is going bad. In this way, repetitive blending back and forth between a low bandwidth audio signal (e.g., analog audio signal) and a high bandwidth audio signal (e.g., digital IBOC signal) is prevented, thereby reducing unpleasant disruptions in the listening experience. In similar fashion, if the advance knowledge indicates that the received digital signal is bad and will get worse, the digital radio receiver may blend to analog and stay in analog longer instead of listening to artifacts generated as the digital signal degrades. In effect, the look ahead metrics provide a window into the future of a few seconds in duration (depending on the band and mode) so that "future" digital audio quality information guides the blend process with advance knowledge about the upcoming signal quality so that the blend algorithm can perform a better operation and provide a better user experience. Another advantage of moving the blend buffer to the input of an audio decoder is that switching between main program service (MPS) audio and supplemental program service (SPS) audio can occur almost instantaneously without any interval of silence that would be required for an audio decoder to fill an output audio blend buffer.

Various illustrative embodiments of the present invention will now be described in detail with reference to the accompanying figures. While various details are set forth in the following description, it will be appreciated that the present invention may be practiced without these specific details, and that numerous implementation-specific decisions may be made to the invention described herein to achieve the device designer's specific goals, such as compliance with process technology or design-related constraints, which will vary from one implementation to another. While such a development effort might be complex and time-consuming, it would nevertheless be a routine undertaking for those of ordinary skill in the art having the benefit of this disclosure. For example, selected aspects are shown in block diagram form, rather than in detail, in order to avoid limiting or obscuring the present invention. Some portions of the detailed descriptions provided herein are presented in terms of algorithms and instructions that operate on data that is stored in a computer memory. Such descriptions and representations are used by those skilled in the art to describe and convey the substance of their work to others skilled in the art. In general, an algorithm refers to a self-consistent sequence of steps leading to a desired result, where a "step" refers to a manipulation of physical quantities which may, though need not necessarily, take the form of electrical or magnetic signals capable of being stored, transferred, combined, compared, and otherwise manipulated. It is common usage to refer to these signals as bits, values, elements, symbols, characters, terms, numbers, or the like. These and similar terms may be associated with the appropriate physical quantities and are merely convenient labels applied to these quantities. Unless specifically stated otherwise as apparent from the following discussion, it is appreciated that, throughout the description, discussions using terms such as "processing" or "computing" or "calculating" or "determining" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

FIGS. 1-10 and the accompanying description herein provide a general description of an exemplary IBOC system, exemplary broadcasting equipment structure and operation, and exemplary receiver structure and operation. FIGS. 11-15 and the accompanying description herein provide contrasting descriptions of conventional and exemplary approaches for blending digital and analog portions of an audio signal in a radio receiver. Whereas aspects of the disclosure are presented in the context of an exemplary IBOC system, it should be understood that the present disclosure is not limited to IBOC systems and that the teachings herein are applicable to other forms of digital radio broadcasting as well.

As referred to herein, a service is any analog or digital medium for communicating content via radio frequency broadcast. For example, in an IBOC radio signal, the analog modulated signal, the digital main program service, and the digital supplemental program services could all be considered services. Other examples of services can include conditionally accessed programs (CAs), which are programs that require a specific access code and can be audio such as, for example, a broadcast of a game or a concert. Additional examples of services can include data services such as, for example, a traffic update service, multimedia and other files, and program service guides (EPGs). A service identifier as referred to herein refers to a particular service. For example, if an analog modulated signal is centered at 94.1 MHz, then a service identifier could refer to the radio frequency of 94.1 MHz. Additionally, the same broadcast in IBOC digital radio broadcasting can include a number of supplemental audio and data services and each could have its own service identifier. Also, a data unit may refer to individual bits, nibbles, bytes, or any other unit of data.

Referring now to FIG. 1, there is shown a functional block diagram of exemplary components of a studio site 10, an FM transmitter site 12, and a studio transmitter link (STL) 14 that can be used to broadcast an FM IBOC digital radio broadcasting signal. The studio site 10 includes, among other things, studio automation equipment 34, an Ensemble Operations Center (EOC) 16 that includes an importer 18, an exporter 20, and an exciter auxiliary service unit (EASU) 22. An STL transmitter 48 links the EOC 16 with the transmitter site 12. The depicted transmitter site 12 includes an STL receiver 54, an exciter 56 that includes an exciter engine (exgine) subsystem 58, and an analog exciter 60. While the exporter 20 is shown in FIG. 1 as residing at a radio station's studio site 10 and the exciter 60 is located at the transmission site 12, these elements may be co-located at the transmission site 12.

At the studio site 10, the studio automation equipment 34 supplies main program service (MPS) audio 42 to the EASU 22, MPS data 40 to the exporter 20, supplemental program service (SPS) audio 38 to the importer 18, and SPS data 36 to the importer 18. MPS audio serves as the main audio programming source. In hybrid modes, it preserves the existing analog radio programming formats in both the analog and digital transmissions. MPS data or SPS data, also known as program service data (PSD), includes information such as music title, artist, album name, etc. Supplemental program service can include supplementary audio content as well as program service data.

The importer 18 contains hardware and software for supplying advanced application services (AAS). AAS can include any type of data that is not classified as MPS, SPS, or Station Information Service (SIS). SIS provides station information, such as call sign, absolute time, position correlated to GPS, etc. Examples of AAS include data services for electronic program guides, navigation maps, real-time traffic and weather information, multimedia applications, other audio services, and other data content. The content for AAS can be supplied by service providers 44, which provide service data 46 to the importer via an application program interface (API). The service providers may be a broadcaster located at the studio site or externally sourced third-party providers of services and content. The importer can establish session connections between multiple service providers. The importer encodes and multiplexes service data 46, SPS audio 38, and SPS data 36 to produce exporter link data 24, which is output to the exporter via a data link. As part of the AAS, the importer also encodes a Service Information Guide (SIG), in which it typically identifies and describes services. For example, the SIG may include data identifying the genre of the services available on the current frequency (e.g., the genre of MPS audio and any SPS audio).

The exporter 20 contains the hardware and software necessary to supply the main program service and SIS for broadcasting. The exporter accepts digital MPS audio 26 over an audio interface and compresses the audio. The exporter also multiplexes MPS data 40, exporter link data 24, and the compressed digital MPS audio to produce exciter link data 52. In addition, the exporter accepts analog MPS audio 28 over its audio interface and applies a pre-programmed delay to it to produce a delayed analog MPS audio signal 30. This analog audio can be broadcast as a backup channel for hybrid IBOC digital radio broadcasting broadcasts. The delay compensates for the system delay of the digital MPS audio, allowing receivers to blend between the digital and analog program without a shift in time. In an AM transmission system, the delayed MPS audio signal 30 is converted by the exporter to a mono signal and sent directly to the STL as part of the exciter link data 52.

The EASU 22 accepts MPS audio 42 from the studio automation equipment 34, rate converts it to the proper system clock, and outputs two copies of the signal, one digital (26) and one analog (28). The EASU 22 includes a GPS receiver that is connected to an antenna 25. The GPS receiver allows the EASU to derive a master clock signal, which is synchronized to the exciter's clock by use of GPS units. The EASU provides the master system clock used by the exporter. The EASU is also used to bypass (or redirect) the analog MPS audio from being passed through the exporter in the event the exporter has a catastrophic fault and is no longer operational. The bypassed audio 32 can be fed directly into the STL transmitter, eliminating a dead-air event.

STL transmitter 48 receives delayed analog MPS audio 50 and exciter link data 52. It outputs exciter link data and delayed analog MPS audio over STL link 14, which may be either unidirectional or bidirectional. The STL link 14 may be a digital microwave or Ethernet link, for example, and may use the standard User Datagram Protocol or the standard TCP/IP.

The transmitter site 12 includes an STL receiver 54, an exciter engine (exgine) 56 and an analog exciter 60. The STL receiver 54 receives delayed analog MPS audio and exciter link data, including audio and data signals as well as command and control messages, over the STL link 14. The exciter link data 66 is passed to the exciter 56, which produces the IBOC digital radio broadcasting waveform. In addition, delayed analog MPS audio is provided to the analog exciter as illustrated by arrow 68. The exciter includes a host processor, digital up-converter, RF up-converter, and exgine subsystem 58. The exgine accepts exciter link data and modulates the digital portion of the IBOC digital radio broadcasting waveform. The digital up-converter of exciter 56 converts from digital-to-analog the baseband portion of the exgine output. The digital-to-analog conversion is based on a GPS clock, common to that of the exporter's GPS-based clock derived from the EASU. Thus, the exciter 56 includes a GPS unit and antenna 57. An alternative method for synchronizing the exporter and exciter clocks can be found in U.S. Pat. No. 7,512,175, the disclosure of which is hereby incorporated by reference in its entirety. The RF up-converter of the exciter up-converts the analog signal to the proper in-band channel frequency. The up-converted signal is then passed to the high power amplifier (HPA) 62 and antenna 64 for broadcast. In an AM transmission system, the exgine subsystem coherently adds the backup analog MPS audio to the digital waveform in the hybrid mode; thus, the AM transmission system does not include the analog exciter 60. In addition, in an AM transmission system, the exciter 56 produces phase and magnitude information and the analog signal is output directly to the high power amplifier.

IBOC digital radio broadcasting signals can be transmitted in both AM and FM radio bands, using a variety of waveforms. The waveforms include an FM hybrid IBOC digital radio broadcasting waveform, an FM all-digital IBOC digital radio broadcasting waveform, an AM hybrid IBOC digital radio broadcasting waveform, and an AM all-digital IBOC digital radio broadcasting waveform.

Figure 2:
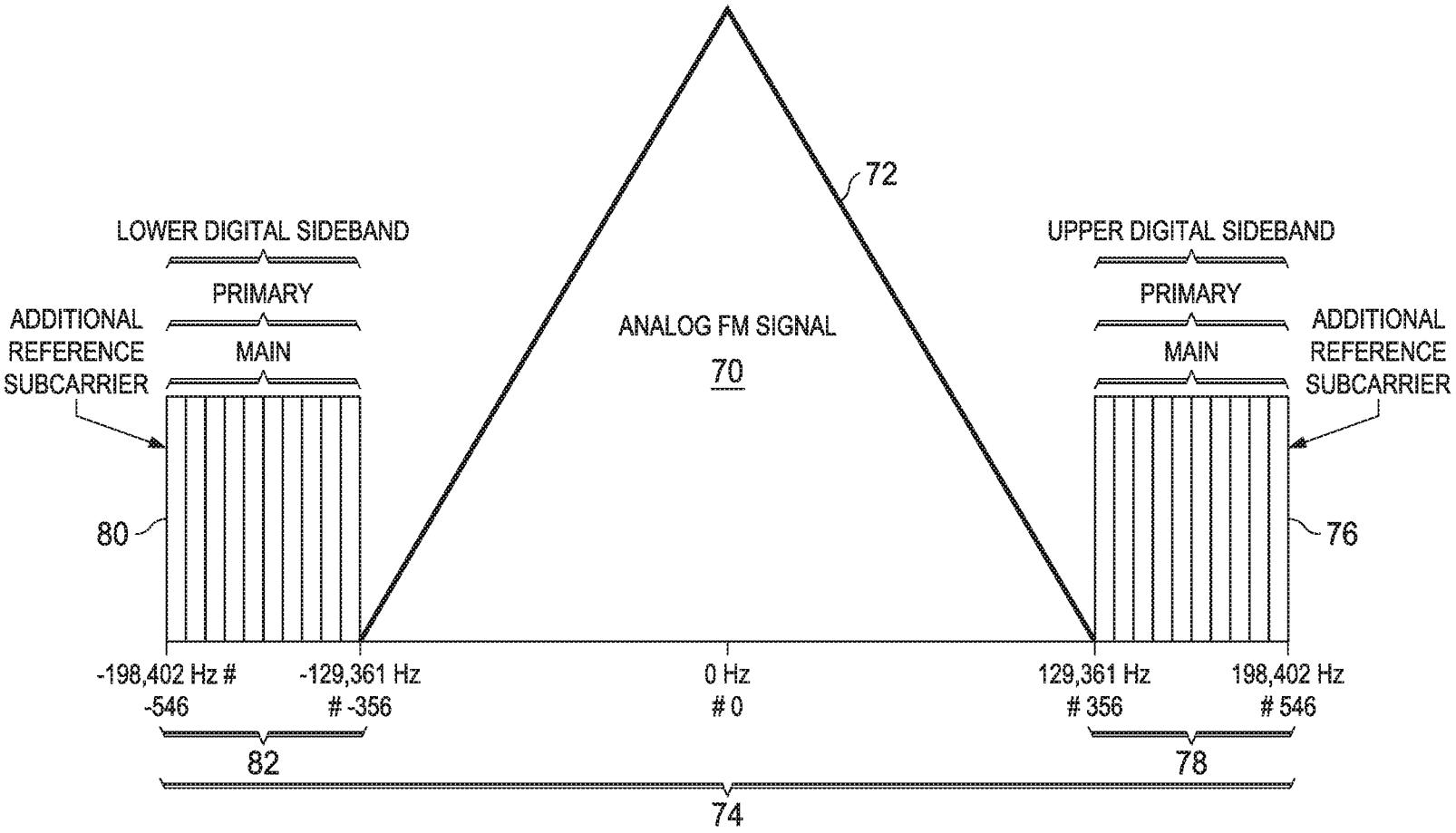
FIG. 2 is a schematic representation of a hybrid FM IBOC waveform.

FIG. 2 is a schematic representation of a hybrid FM IBOC waveform 70. The waveform includes an analog modulated signal 72 located in the center of a broadcast channel 74, a first plurality of evenly spaced orthogonally frequency division multiplexed subcarriers 76 in an upper sideband 78, and a second plurality of evenly spaced orthogonally frequency division multiplexed subcarriers 80 in a lower sideband 82. The digitally modulated subcarriers are divided into partitions and various subcarriers are designated as reference subcarriers. A frequency partition is a group of 19 OFDM subcarriers containing 18 data subcarriers and one reference subcarrier.

The hybrid waveform 70 includes an analog FM-modulated signal, plus digitally modulated primary main subcarriers. The subcarriers are located at evenly spaced frequency locations. The subcarrier locations are numbered from −546 to 546. In the depicted waveform 70, the subcarriers are at locations +356 to +546 and −356 to −546. Each primary main sideband is comprised often frequency partitions. Subcarriers 546 and −546, also included in the primary main sidebands, are additional reference subcarriers. The amplitude of each subcarrier can be scaled by an amplitude scale factor.

Figure 3:
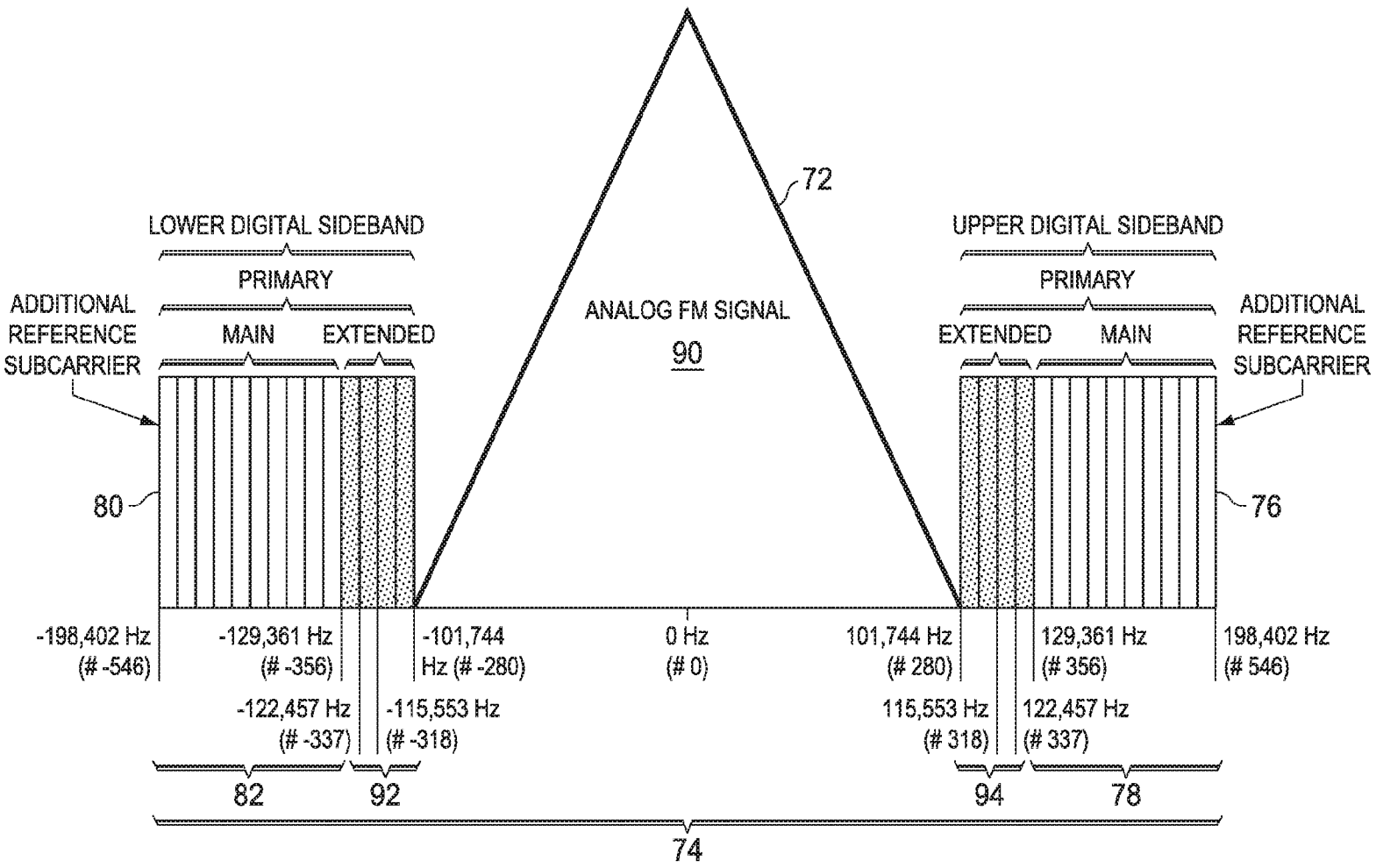
FIG. 3 is a schematic representation of an extended hybrid FM IBOC waveform.

FIG. 3 is a schematic representation of an extended hybrid FM IBOC waveform 90. The extended hybrid waveform 90 is created by adding primary extended sidebands 92, 94 to the primary main sidebands 78, 82 present in the hybrid waveform. One, two, or four frequency partitions can be added to the inner edge of each primary main sideband. The extended hybrid waveform 90 includes the analog FM signal plus digitally modulated primary main subcarriers (subcarriers +356 to +546 and −356 to −546) and some or all primary extended subcarriers (subcarriers +280 to +355 and −280 to −355).

The upper primary extended sidebands include subcarriers 337 through 355 (one frequency partition), 318 through 355 (two frequency partitions), or 280 through 355 (four frequency partitions). The lower primary extended sidebands include subcarriers −337 through −355 (one frequency partition), −318 through −355 (two frequency partitions), or −280 through −355 (four frequency partitions). The amplitude of each subcarrier can be scaled by an amplitude scale factor.

Figure 4:
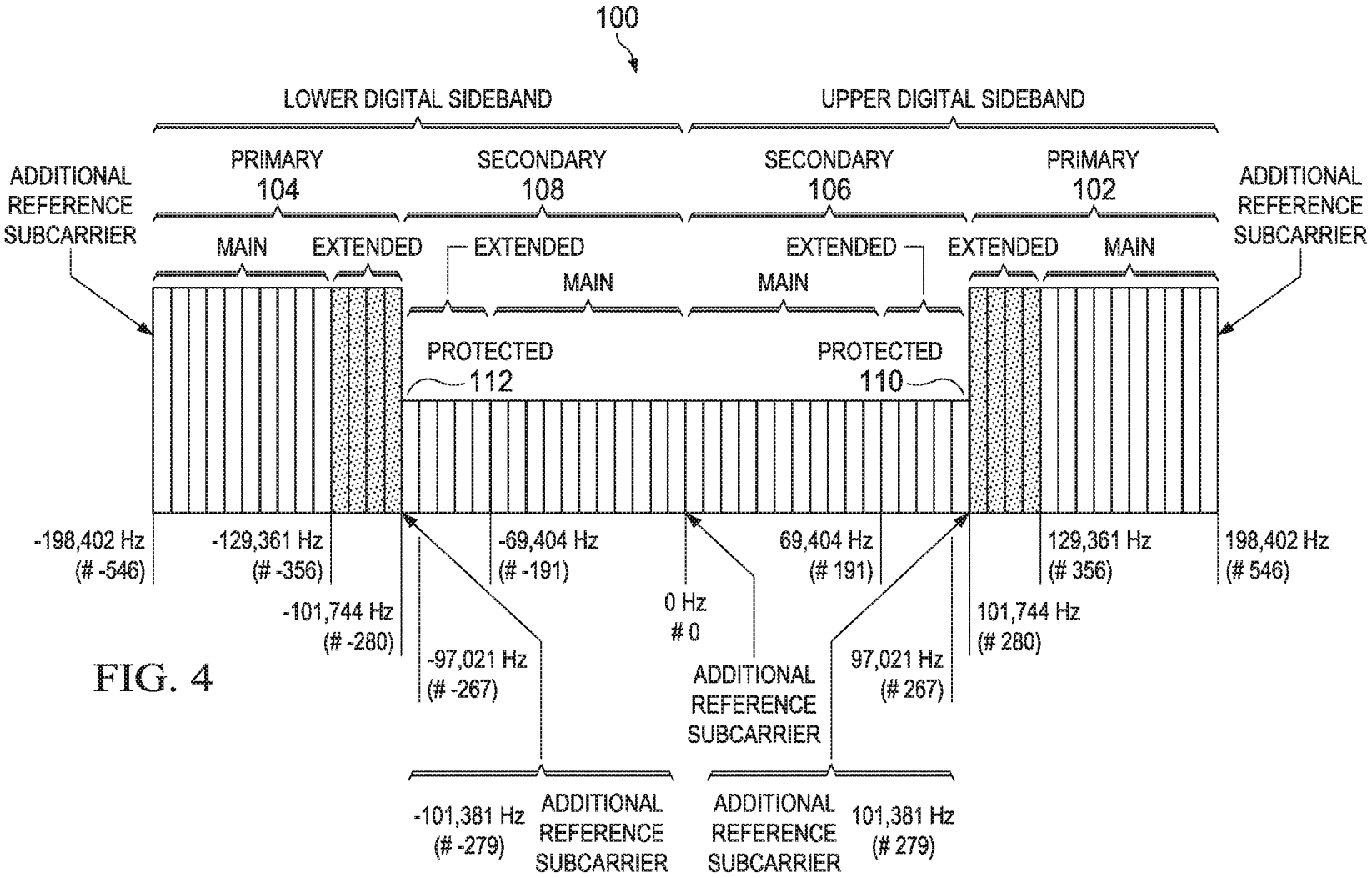
FIG. 4 is a schematic representation of an all-digital FM IBOC waveform.

FIG. 4 is a schematic representation of an all-digital FM IBOC waveform 100. The all-digital waveform 100 is constructed by disabling the analog signal, fully extending the bandwidth of the primary digital sidebands 102, 104, and adding lower-power secondary sidebands 106, 108 in the spectrum vacated by the analog signal. The all-digital waveform 100 in the illustrated embodiment includes digitally modulated subcarriers at subcarrier locations −546 to +546, without an analog FM signal.

In addition to the ten main frequency partitions, all four extended frequency partitions are present in each primary sideband of the all-digital waveform. Each secondary sideband also has ten secondary main (SM) and four secondary extended (SX) frequency partitions. Unlike the primary sidebands, however, the secondary main frequency partitions are mapped nearer to the channel center with the extended frequency partitions farther from the center.

Each secondary sideband also supports a small secondary protected (SP) region 110, 112 including 12 OFDM subcarriers and reference subcarriers 279 and −279. The sidebands are referred to as "protected" because they are located in the area of spectrum least likely to be affected by analog or digital interference. An additional reference subcarrier is placed at the center of the channel (0). Frequency partition ordering of the SP region does not apply since the SP region does not contain frequency partitions.

Each secondary main sideband spans subcarriers 1 through 190 or −1 through −190. The upper secondary extended sideband includes subcarriers 191 through 266, and the upper secondary protected sideband includes subcarriers 267 through 278, plus additional reference subcarrier 279. The lower secondary extended sideband includes subcarriers −191 through −266, and the lower secondary protected sideband includes subcarriers −267 through −278, plus additional reference subcarrier −279. The total frequency span of the entire all-digital spectrum may be up to 396,803 Hz. The amplitude of each subcarrier can be scaled by an amplitude scale factor.

In each of the waveforms 70, 90, 100, the digital signal is modulated using orthogonal frequency division multiplexing (OFDM). OFDM is a parallel modulation scheme in which the data stream modulates a large number of orthogonal subcarriers, which are transmitted simultaneously. OFDM is inherently flexible, readily allowing the mapping of logical channels to different groups of subcarriers.

In the hybrid waveform 70, the digital signal is transmitted in primary main (PM) sidebands on either side of the analog FM signal in the hybrid waveform. The power level of each sideband is separately adjusted and is appreciably below the total power in the analog FM signal. The analog signal may be monophonic or stereophonic, and may include subsidiary communications authorization (SCA) channels.

In the extended hybrid waveform 90, the bandwidth of the hybrid sidebands can be extended toward the analog FM signal to increase digital capacity. This additional spectrum, allocated to the inner edge of each primary main sideband, is termed the primary extended (PX) sideband.

In the all-digital waveform 100, the analog signal is removed and the bandwidth of the primary digital sidebands (or sideband when only one is employed) is fully extended as in the extended hybrid waveform. In addition, this waveform allows lower-power digital secondary sidebands to be transmitted in the spectrum vacated by the analog FM signal.

Figure 5:
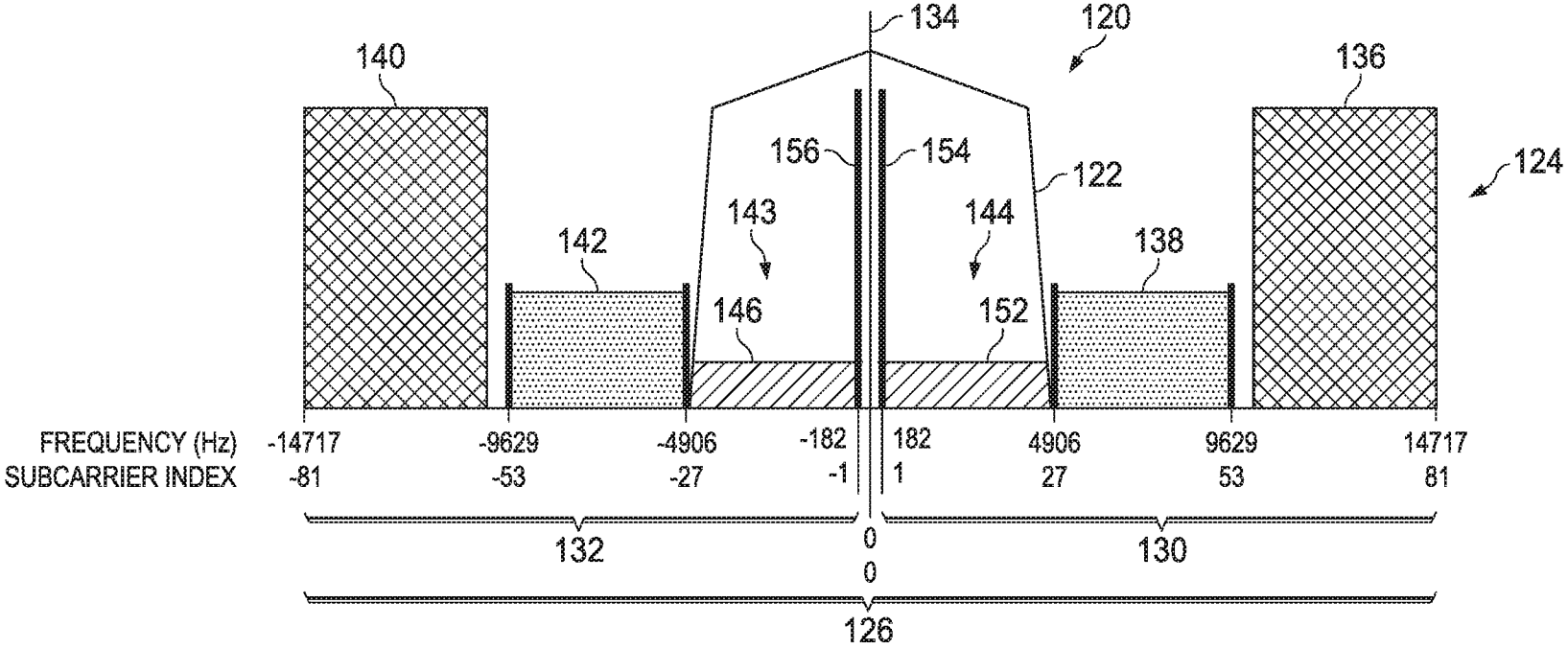
FIG. 5 is a schematic representation of a hybrid AM IBOC waveform.

FIG. 5 is a schematic representation of an AM hybrid IBOC digital radio broadcasting waveform 120. The hybrid format includes the conventional AM analog signal 122 (bandlimited to about ±5 kHz) along with up to a nearly 30 kHz wide digital radio broadcasting signal 124. The spectrum is contained within a channel 126 having a bandwidth of about 30 kHz. The channel is divided into upper 130 and lower 132 frequency bands. The upper band extends from the center frequency of the channel to about +15 kHz from the center frequency. The lower band extends from the center frequency to about −15 kHz from the center frequency.

The AM hybrid IBOC digital radio broadcasting signal format in one example comprises the analog modulated carrier signal 134 plus OFDM subcarrier locations spanning the upper and lower bands. Coded digital information representative of the audio or data signals to be transmitted (program material), is transmitted on the subcarriers. The symbol rate is less than the subcarrier spacing due to a guard time between symbols.

As shown in FIG. 5, the upper band is divided into a primary section 136, a secondary section 138, and a tertiary section 144. The lower band is divided into a primary section 140, a secondary section 142, and a tertiary section 143. For the purpose of this explanation, the tertiary sections 143 and 144 can be considered to include a plurality of groups of subcarriers labeled 146 and 152 in FIG. 5. Subcarriers within the tertiary sections that are positioned near the center of the channel are referred to as inner subcarriers, and subcarriers within the tertiary sections that are positioned farther from the center of the channel are referred to as outer subcarriers. The groups of subcarriers 146 and 152 in the tertiary sections have substantially constant power levels. FIG. 5 also shows two reference subcarriers 154 and 156 for system control, whose levels are fixed at a value that is different from the other sidebands.

The power of subcarriers in the digital sidebands is significantly below the total power in the analog AM signal. The level of each OFDM subcarrier within a given primary or secondary section is fixed at a constant value. Primary or secondary sections may be scaled relative to each other. In addition, status and control information is transmitted on reference subcarriers located on either side of the main carrier. A separate logical channel, such as an IBOC Data Service (IDS) channel can be transmitted in individual subcarriers just above and below the frequency edges of the upper and lower secondary sidebands. The power level of each primary OFDM subcarrier is typically fixed relative to the unmodulated main analog carrier. However, the power level of the secondary subcarriers, logical channel subcarriers, and tertiary subcarriers is adjustable.

Using the modulation format of FIG. 5, the analog modulated carrier and the digitally modulated subcarriers are transmitted within the channel mask specified for standard AM broadcasting in the United States. The hybrid system uses the analog AM signal for tuning and backup.

Figure 6:
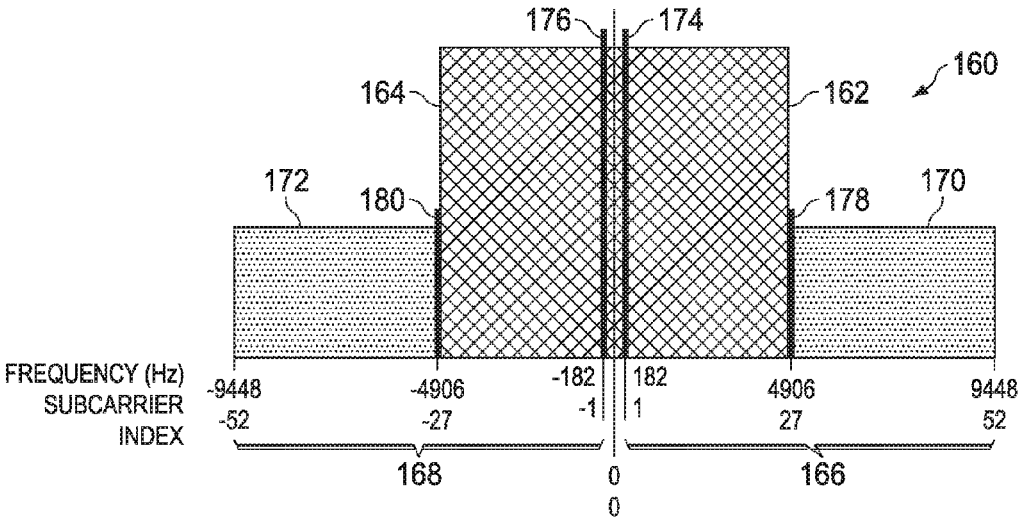
FIG. 6 is a schematic representation of an all-digital AM IBOC waveform.

FIG. 6 is a schematic representation of the subcarrier assignments for an all-digital AM IBOC digital radio broadcasting waveform. The all-digital AM IBOC digital radio broadcasting signal 160 includes first and second groups 162 and 164 of evenly spaced subcarriers, referred to as the primary subcarriers, that are positioned in upper and lower bands 166 and 168. Third and fourth groups 170 and 172 of subcarriers, referred to as secondary subcarriers, are also positioned in upper and lower bands 166 and 168. Two reference subcarriers 174 and 176 of the third group lie closest to the center of the channel. Subcarriers 178 and 180 can be used to transmit program information data.

Figure 7A:
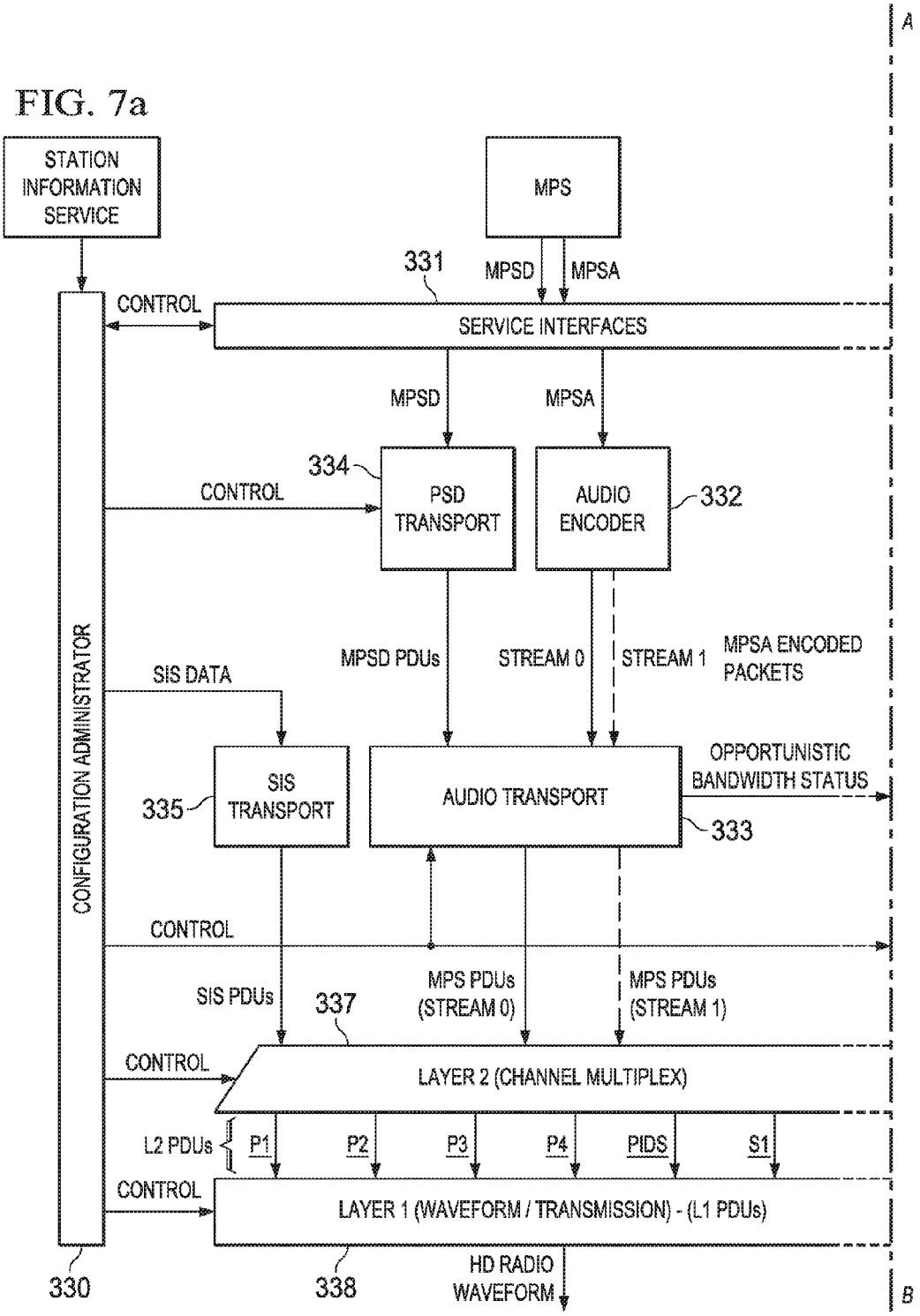

FIGS. 7*a-b* show diagrams of an IBOC digital radio broadcasting logical protocol stack from the transmitter perspective. From the receiver perspective, the logical stack will be traversed in the opposite direction. Most of the data being passed between the various entities within the protocol stack are in the form of protocol data units (PDUs). A PDU is a structured data block that is produced by a specific layer (or process within a layer) of the protocol stack. The PDUs of a given layer may encapsulate PDUs from the next higher layer of the stack and/or include content data and protocol control information originating in the layer (or process) itself. The PDUs generated by each layer (or process) in the transmitter protocol stack are inputs to a corresponding layer (or process) in the receiver protocol stack.

As shown in FIGS. 7*a-b*, there is a configuration administrator 330, which is a system function that supplies configuration and control information to the various entities within the protocol stack. The configuration/control information can include user defined settings, as well as information generated from within the system such as GPS time and position. The service interfaces 331 represent the interfaces for all services. The service interface may be different for each of the various types of services. For example, for MPS audio and SPS audio, the service interface may be an audio card. For MPS data and SPS data the interfaces may be in the form of different APIs. For all other data services the interface is in the form of a single API. An audio encoder 332 encodes both MPS audio and SPS audio to produce core (Stream 0) and optional enhancement (Stream 1) streams of MPS and SPS audio encoded packets, which are passed to audio transport 333. Audio encoder 332 also relays unused capacity status to other parts of the system, thus allowing the inclusion of opportunistic data. MPS and SPS data is processed by PSD transport 334 to produce MPS and SPS data PDUs, which are passed to audio transport 333. Audio transport 333 receives encoded audio packets and PSD PDUs and outputs bit streams containing both compressed audio and program service data. The SIS transport 335 receives SIS data from the configuration administrator and generates SIS PDUs. A SIS PDU can contain station identification and location information, indications regarding provided audio and data services, as well as absolute time and position correlated to GPS, as well as other information conveyed by the station. The AAS data transport 336 receives AAS data from the service interface, as well as opportunistic bandwidth data from the audio transport, and generates AAS data PDUs, which can be based on quality of service parameters. The transport and encoding functions are collectively referred to as Layer 4 of the protocol stack and the corresponding transport PDUs are referred to as Layer 4 PDUs or L4 PDUs. Layer 2 (337), which is the channel multiplex layer, receives transport PDUs from the SIS transport. AAS data transport, and audio transport, and formats them into Layer 2 PDUs. A Layer 2 PDU includes protocol control information and a payload, which can be audio, data, or a combination of audio and data. Layer 2 PDUs are routed through the correct logical channels to Layer 1 (338), wherein a logical channel is a signal path that conducts L1 PDUs through Layer 1 with a specified grade of service, and possibly mapped into a predefined collection of subcarriers. There are multiple Layer 1 logical channels based on service mode, wherein a service mode is a specific configuration of operating parameters specifying throughput, performance level, and selected logical channels. The number of active Layer 1 logical channels and the characteristics defining them vary for each service mode. Status information is also passed between Layer 2 and Layer 1. Layer 1 converts the PDUs from Layer 2 and system control information into an AM or FM IBOC digital radio broadcasting waveform for transmission. Layer 1 processing can include scrambling, channel encoding, interleaving, OFDM subcarrier mapping, and OFDM signal generation. The output of OFDM signal generation is a complex, baseband, time domain pulse representing the digital portion of an IBOC signal for a particular symbol. Discrete symbols are concatenated to form a continuous time domain waveform, which is modulated to create an IBOC waveform for transmission.

Figure 8:
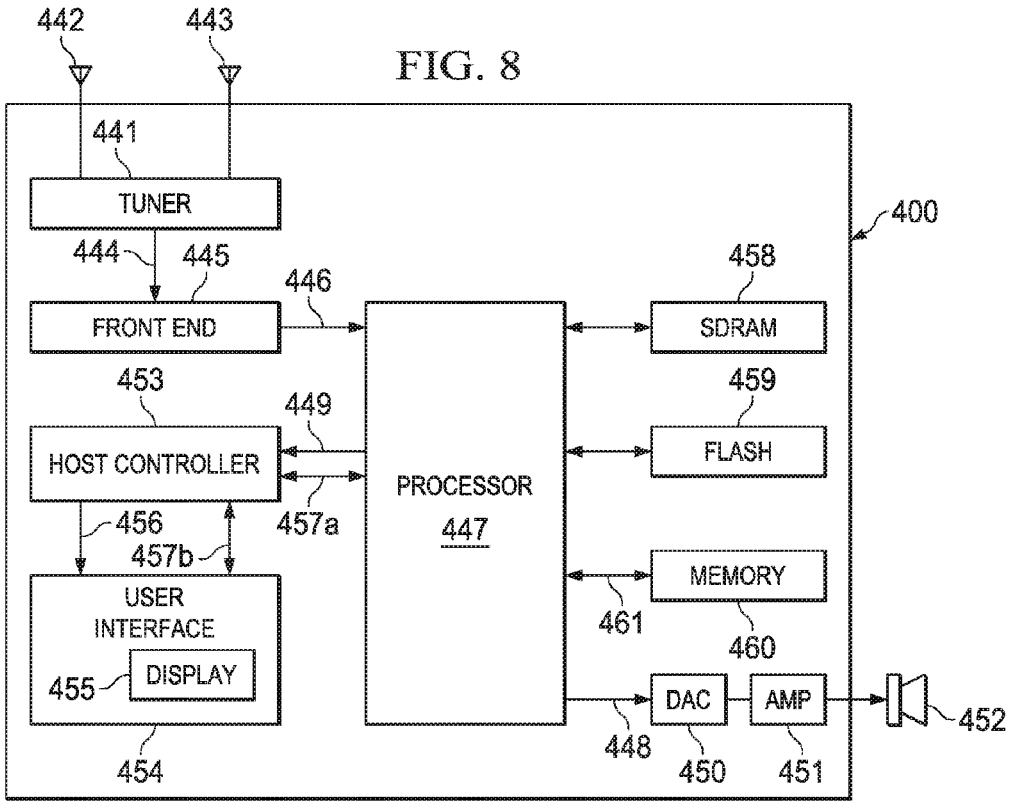
FIG. 8 is a simplified functional block diagram of an digital radio receiver.

A digital radio broadcast receiver performs the inverse of some of the functions described for the transmitter. FIG. 8 is a simplified functional block diagram of a digital radio receiver 400 with components that will allow the reception and decoding of a digital audio broadcast (DAB) signal. The exemplary digital radio receiver 400 may be a DAB receiver such as an AM or FM IBOC receiver, for example. While only certain components of the receiver 400 are shown for exemplary purposes, it should be apparent that the receiver may comprise a number of additional components and may be distributed among a number of separate enclosures having tuners and front-ends, speakers, remote controls, various input/output devices, etc. At the receiver 400, the DAB signal is received on one or more antennas, such as an AM antenna 442 and an FM antenna 443 for receiving radio signals, which may be modulated with an all-digital, all analog, or hybrid IBOC waveform. The received DAB signal is processed by the tuner 441 to produce an intermediate frequency (IF) signal 444 that is passed to a front end circuit 445, which transforms the IF signal to baseband signal 446. For example, the tuner 441 may include a bandpass preselect filter which passes the frequency band of interest (e.g., $f_c$), a low noise amplifier (LNA) for amplifying the filtered signal, a mixer which mixes the amplified signal with a tunable local oscillator signal $f_{lo}$ to create sum ($f_c+f_{lo}$) and difference ($f_c-f_{lo}$) signals that are supplied to an intermediate frequency filter which passes the intermediate frequency signal $f_{if}$ at the modulated signal of interest on line 444. In the front end circuit 445, an analog-to-digital converter (ADC) may produce digital samples which are digitally down converted by applying frequency shifts, filters and decimation to produce the baseband signal 446 as lower sample rate in-phase and quadrature signals. A processor 447 processes the baseband signal 446 according to the logical protocol stack described by FIG. 9 (described below) to produce a decoded digital audio signal 448 and a decoded digital data signal 449. Without belaboring the details, the processor 447 may be embodied as an AM/FM baseband processor which includes an analog demodulator for demodulating the analog modulated portion of the baseband signal 446 to produce an analog audio signal, a digital demodulator for demodulating the digitally modulated portion of the baseband signal 446 to generate a digital signal which is deinterleaved and Viterbi decoded before being demultiplexed into separate main and supplemental program signals which are processed to form a main digital audio signal which may be blended with the analog audio signal to produce an audio output on line 448.

Digital-to-analog (DAC) converter 450 converts the decoded digital audio signal 448 to an analog signal and passes it to an amplifier 451 for output to audio sink or other output device 452, which can be one or more speakers, headphones, or any other type of audio output device, produces an audio output. Decoded digital data signal 449 is passed to a host controller 453 over one or more data lines 449 which may be multiplexed together onto a suitable bus such as an inter-integrated circuit (I2C), serial peripheral interface (SPI), universal asynchronous receiver/transmitter (UART), or universal serial bus (USB). The data signals can include, for example, SIS, MPS data, SPS data, and one or more AAS. The host controller 453 receives and processes the data signals (e.g., the SIS, MPSD, SPSD, and AAS signals) using any suitable microcontroller, such as an 8-bit reduced instruction set computer (RISC) microcontroller, an advanced RISC 32-bit microcontroller or any other suitable microcontroller. Additionally, a portion or all of the functions of the host controller 453 could be performed in a baseband processor (e.g., the processor 447). In certain embodiments the host controller 453 may also control user input from a keyboard, dials, knobs or other suitable inputs. The host controller 453 sends digital data 456 to a user interface (UI) 454, which can include a display 455 for outputting visual representations of the data such as text or images. The host controller 453 also exchanges status and control information 457*a*, 457*b* with the processor 447 and user interface 454.

The receiver 400 may also include memories 458 and 459 for use by the processor 447, which may share a memory bus for communicating with the processor, and memory 460 for storing program content selected by the user. Memory 460 is preferably a non-removable storage device such as a multimedia card (MMC). Other suitable types of memory devices may be used, such as a hard disc, flash memory, USB memory, memory stick, etc.

In practice, many of the signal processing functions shown in the receiver 400 of FIG. 8 can be implemented using one or more integrated circuits. For example, while the signal processing block, host controller, and memory module are shown as separate components, the functions of two or more of these components could be combined in a single processor (e.g., a System on a Chip (SoC)).

Figure 9:
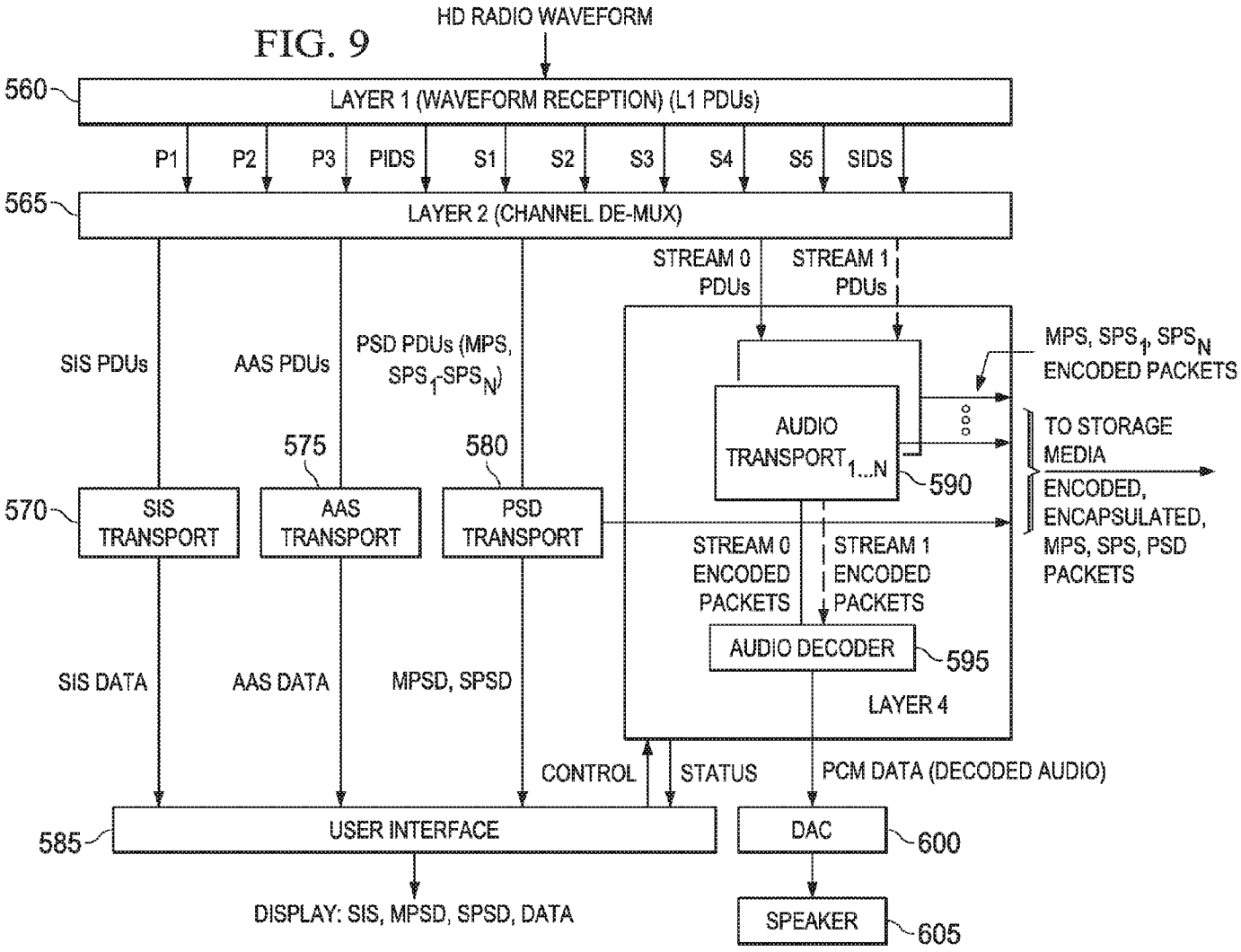
FIG. 9 is a diagram of an FM IBOC digital radio broadcasting logical protocol stack from the receiver perspective.

FIG. 9 shows the logical protocol stack from the receiver perspective. An FM IBOC waveform is received by the physical layer, Layer 1 (560), which demodulates the signal and processes it to separate the signal into logical channels. The number and kind of logical channels will depend on the service mode, and may include logical channels P1-P3, Primary IBOC Data Service Logical Channel (PIDS), S1-S5, and SIDS. In addition, logical channels for data services may be divided into sub-channels by, for example, time-division multiplexing. These sub-channels can provide additional divisibility of the logical channels to facilitate a wider variety of data services.

Layer 1 produces L1 PDUs corresponding to the logical channels and sends the PDUs to Layer 2 (565), which demultiplexes the L1 PDUs to produce SIS PDUs, AAS PDUs, PSD PDUs for the main program service and any supplemental program services, and Stream 0 (core) audio PDUs and Stream 1 (optional enhanced) audio PDUs. The SIS PDUs are then processed by the SIS transport 570 to produce SIS data, the AAS PDUs are processed by the AAS transport 575 to produce AAS data, and the PSD PDUs are processed by the PSD transport 580 to produce MPS data (MPSD) and any SPS data (SPSD). Encapsulated PSD data may also be included in AAS PDUs, thus processed by the AAS transport processor 575 and delivered on line 577 to PSD transport processor 580 for further processing and producing MPSD or SPSD. The SIS data, AAS data, MPSD and SPSD are then sent to a user interface 585. The SIS data, if requested by a user, can then be displayed. Likewise, MPSD, SPSD, and any text based or graphical AAS data can be displayed. The Stream 0 and Stream 1 PDUs are processed by Layer 4, comprised of audio transport 590 and audio decoder 595. There may be up to N audio transports corresponding to the number of programs received on the IBOC waveform. Each audio transport produces encoded MPS packets or SPS packets, corresponding to each of the received programs. Layer 4 receives control information from the user interface, including commands such as to store or play programs, and information related to seek or scan for radio stations broadcasting an all-digital or hybrid IBOC signal. Layer 4 also provides status information to the user interface.

As previously discussed, IBOC digital radio broadcasting signals can be transmitted in a hybrid format that includes an analog modulated carrier (e.g., frequency modulated (FM) or amplitude modulated (AM)) in combination with a plurality of digitally modulated carriers (e.g., orthogonal frequency division multiplexing (OFDM) sub-carriers). Thus the digital radio broadcast receiver operating in hybrid mode decodes both an analog portion (e.g., FM or AM) and a digital portion (e.g., OFDM) of the digital radio broadcast audio signal.

In the absence of the digital portion of the digital radio broadcast audio signal (for example, when the channel is initially tuned, or when a channel outage occurs), the analog AM or FM backup audio signal is fed to the audio output. When the digital signal becomes available, the baseband processor (e.g., 447) implements a blending or audio transition function to smoothly attenuate and eventually remove the analog backup signal while adding in the digital audio signal such that the transition is minimally noticeable. Similar transitioning occurs during channel outages which corrupt the digital signal. The corruption may be detected during the diversity delay time through cyclic redundancy checking (CRC) error detection means. In this case the analog signal is gradually transitioned into the output audio signal while attenuating the DAB signal such that the audio is fully transitioned to analog when the digital corruption appears at the audio output. Furthermore, the receiver outputs the analog audio signal whenever the digital signal is not present.

In an exemplary digital audio broadcasting receiver, the analog backup signal is detected and demodulated producing a 44.1 kHz audio sample stream (stereo in the case of FM which can further blend to mono or mute under low SNR conditions). At 44.1 kHz, each audio sample is approximately 22.67 microseconds in duration. The 44.1 kHz sample rate is synchronous with the receiver's front-end clock. The audio sample decoder in the baseband processor (e.g., 447) also generates audio samples at approximately 44.1 kHz. Minute differences in the 44.1 kHz clocks between the transmitter and receiver prevent simple one-to-one combining of the analog signal samples with the digital signal samples since the audio content may start at different points and eventually drift apart over time. Accordingly, the receiver and the transmitter clock should be synchronized to maintain alignment of the audio samples.

Figure 10:
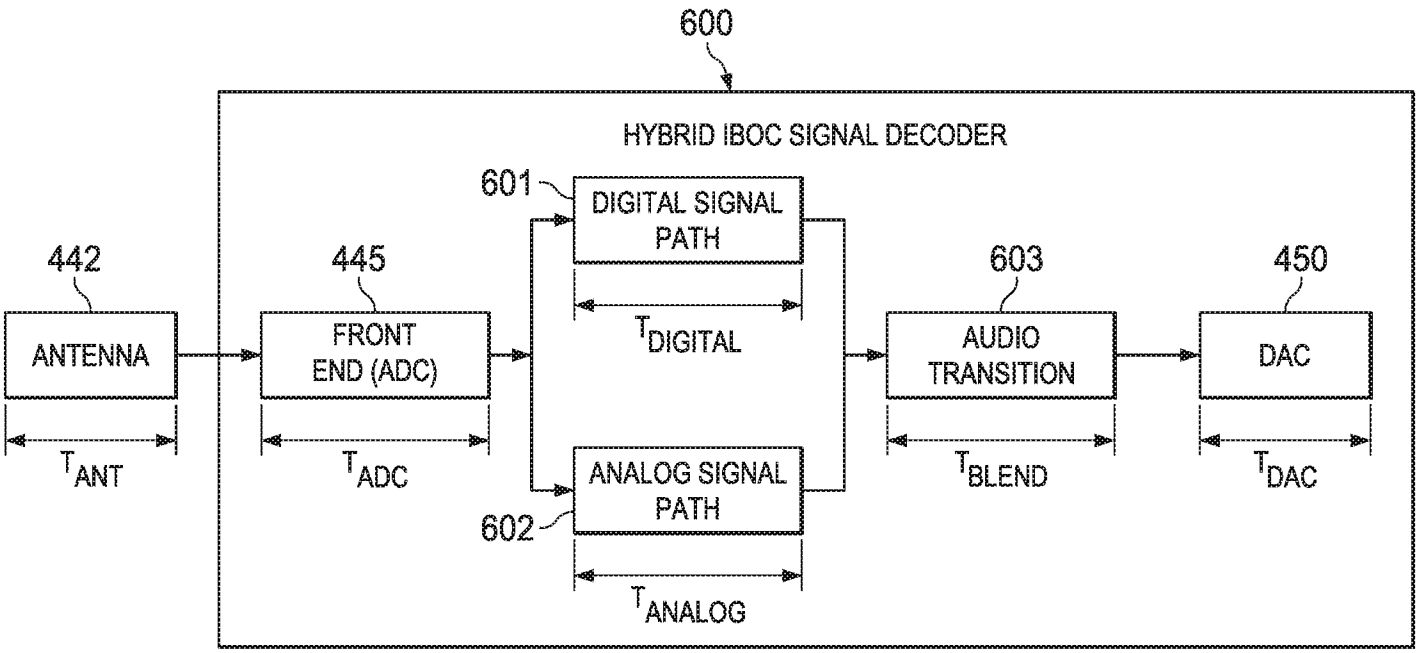
FIG. 10 illustrates a timing block diagram of an exemplary digital broadcast receiver in accordance with selected embodiments.

Referring now to FIG. 10, there is shown a simplified timing block diagram of an exemplary digital broadcast receiver for aligning and blending digital and analog audio signals contained in a received hybrid radio broadcast signal in accordance with selected embodiments. Upon reception at the antenna 442, the received hybrid signal is processed for an amount of time $T_{ANT}$ which is typically a constant amount of time that will be implementation dependent. The received hybrid signal is then digitized, demodulated, and decoded by the IBOC signal decoder 600, starting with an analog-to-digital converter (ADC) 445 as described above which processes the signal for an amount of time $T_{ADC}$ which is typically an implementation-dependent constant amount of time to produce digital samples which are down converted to produce lower sample rate output digital signals.

In the IBOC signal decoder 600, the digitized hybrid signal is split into a digital signal path 601 and an analog signal path 602 for demodulation and decoding. In the analog path 602, the received analog portion of the hybrid signal is processed for an amount of time $T_{ANALOG}$ to produce audio samples representative of the analog portion of the received hybrid signal, where $T_{ANALOG}$ is typically a constant amount of time that is implementation dependent. In the digital signal path 601, the digital signal is acquired, demodulated, and decoded into digital audio samples as described in more detail below. The processing in the digital signal path 601 requires a variable amount of time $T_{DIGITAL}$ that will depend on the acquisition time of the digital signal and the demodulation times of the digital signal path 601. The acquisition time can vary depending on the strength of the digital signal due to radio propagation interference such as fading and multipath. The digital signal path 601 applies Layer 1 processing to demodulate the received digital IBOC signal using a fairly deterministic process that provides very little or no buffering of data based on a particular implementation. The digital signal path 601 then feeds the resulting data to one or more upper layer modules which decode the demodulated digital signal to maximize audio quality. In selected embodiments, the upper layer decoding process involves buffering of the received signal based on over-the-air conditions. In selected embodiments, the upper layer module(s) may implement a deterministic process for each IBOC service mode (MP1-MP3, MP5, MP6, MP11, MA1 and MA3). As described hereinbelow, the upper layer decoding process includes a blend decision module which guides the blending of the audio and analog signals in the audio transition or blending module 603. The time required to process the blend decision at the audio transition module 603 is a constant amount of time $T_{BLEND}$.

At the audio transition or blending module 603, the samples from the digital signal are aligned and blended with the samples from the analog signal (provided directly from the analog signal path 602) using guidance control signaling from the digital signal path 601 to avoid unnecessary blending from analog to digital. The time required to align and blend the digital and analog signals together at the audio transition module 603 is a constant amount of time $T_{TRANSITION}$. Finally, the combined digitized audio signal is converted into analog for rendering via the digital-to-analog converter (DAC) 450 during processing time $T_{DAC}$ which is typically a constant amount of time that will be implementation-dependent.

Figure 11:
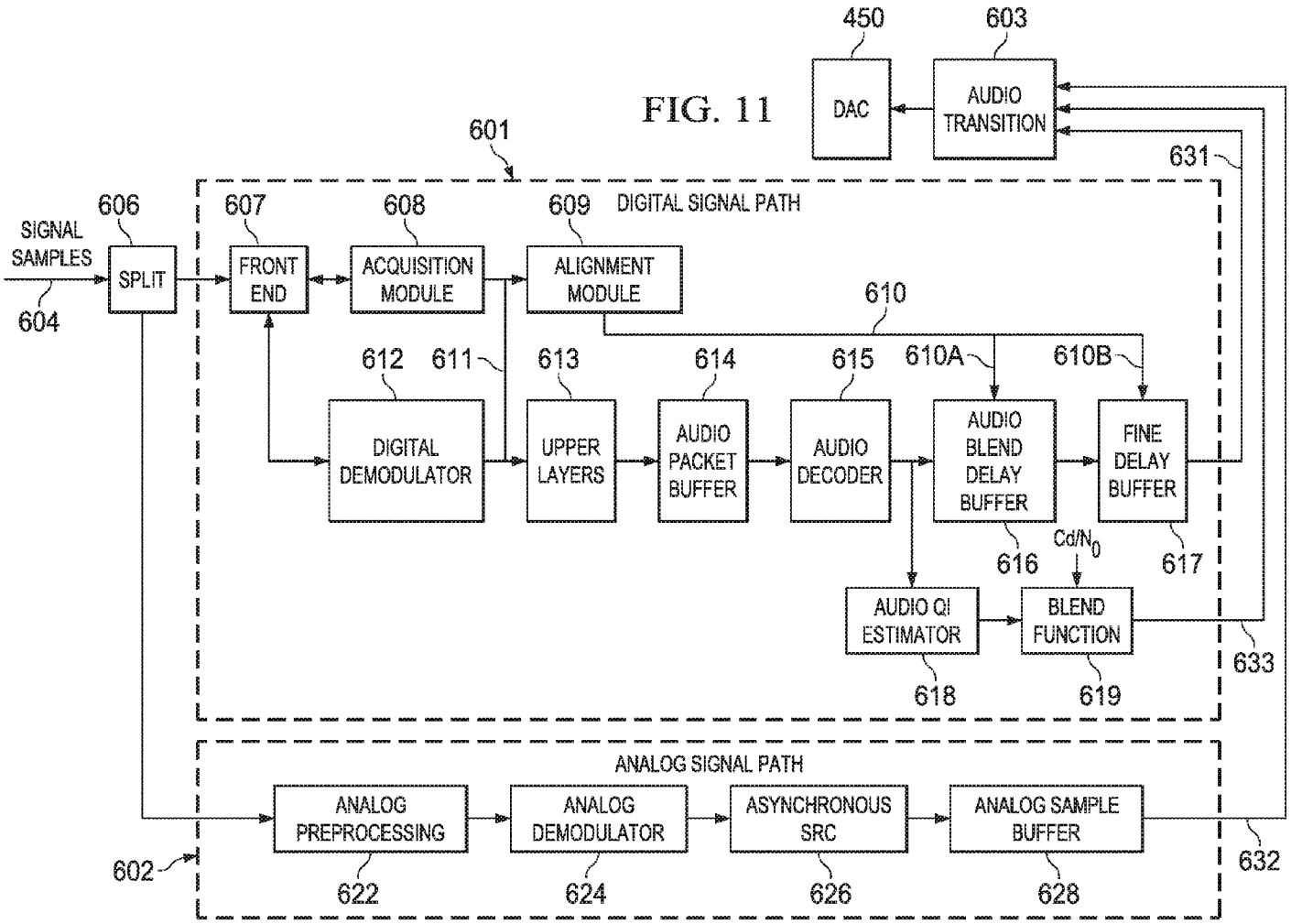
FIG. 11 illustrates a block diagram of the digital and analog signal paths in a digital broadcast receiver.

An exemplary functional block diagram of a process for aligning analog and digital audio signals is illustrated in FIG. 11. The illustrated functions can be performed in the baseband processor (e.g., 447 in FIG. 8) which embodies a processing system that may include one or more processing units configured (e.g., programmed with software and/or firmware) to perform the functionality described herein, wherein the processing system of the baseband processor can be suitably coupled to any suitable memory (e.g., RAM, Flash ROM, ROM). For example, a semiconductor chip may be fabricated by known methods in the art to include a processing system that comprises one or more processors as well as a memory, e.g., the processing system and the memory may be arranged in a single semiconductor chip, if desired, according to known methods.

At the baseband processor, the received signal samples 604 containing both the analog and digital portion enter a split module 606, where the baseband input signal is split into the digital signal path 601 and the analog signal path 602 using signal splitting techniques (e.g., filters) known to those skilled in the art. In the digital path 601, the digital samples enter a front-end module 607 which filters and dispenses the symbols comprising the digital signal, such as by using an isolation filter to filter and isolate the DAB upper and lower sidebands which are passed through an optional first adjacent canceler for attenuating interfering adjacent FM signal bands prior to accumulating the filtered samples of interest in a symbol dispenser (e.g., a RAM buffer).

The digital samples from the front end module 607 are input into an acquisition module 608 which acquires or recovers OFDM symbol timing offset or error and carrier frequency offset or error from received OFDM symbols. The acquisition module 608 also develops an acquisition symbol offset signal that adjusts the location of the pointer in the symbol dispenser of the front-end module 607. When the acquisition module 608 indicates that it has acquired the digital signal, it adjusts the location of a sample pointer in the symbol dispenser based on the acquisition time with an acquisition symbol offset, and then calls the digital demodulator 612 over control line 611.

A digital demodulator 612 then receives the digital signal and performs all the necessary operations of deinterleaving, code combining, FEC decoding, and error flagging of the received compressed audio data. The baseband signal is then passed to the upper layers module 613 which de-multiplexes the audio and data signals and performs audio transport decoding (e.g., Layer 2 and the audio transport portion of Layer 4 as described above in connection with FIG. 9). As a result of the audio transport processing in the upper layers module 613, compressed audio packets for the main and supplemental programs are extracted and stored in the audio packet buffer 614. The audio information from each modem frame is processed by an audio decoder 615 which receives the compressed audio packets from the audio packet buffer 614 and which produces therefrom PCM audio samples. The audio decoder 615 may be embodied as a codec (HDC) which is configured to decompress the digital audio packets and output them to an audio blend delay output buffer 616, where they are queued. The audio blend delay output buffer 616 may be any suitable memory, such as a first-in-first-out (FIFO) implemented in RAM, to introduce a delay into the audio samples of an amount that is calculated in the alignment module 609, such that the leading edges of the digital audio samples are aligned with the equivalent analog samples.

The alignment module 609 calculates a delay amount 610 that includes a coarse delay 610A and a fine delay 610B. The alignment module 609 typically determines the delay amount upon acquisition of a new signal, for example such as upon tuning the receiver to a new frequency or loss and subsequent reacquisition of a current signal. In the receiver, Layer 1 (e.g., the front-end module 607, acquisition module 608, and digital demodulator 612) may operate at a different rate than the upper layers (e.g., the upper layers 613 and the audio decoder 615). Layer 1 processing times are typically dictated by the front-end interrupts (input) in samples/PDU while the upper layer processing times are dictated by the DAC interrupts (output) in packets. Since two different systems are driving the processing at two different time scales, it is desirable to put both on the same time scale by configuring the alignment module 609 to determine the amount of time data representing the first sample spends in Layer 1 until it reaches the interface of Layer 2. This is the point where the processing changes from sample/PDU to packets.

The coarse delay 610A provided to the audio blend delay output buffer 616 is a predetermined constant value that accounts for the diversity delay and the constant processing delays in the receiver and is used to temporally align the audio samples from the digital signal with the audio samples from the analog signal in a granularity of ±one audio frame. Accordingly, the value of the coarse delay 610A will be implementation specific and may be different for AM and FM modes. The fine delay 610B provided to the fine delay buffer 617 is a predetermined constant value that accounts for small differences in the processing delays between the analog and digital paths in the receiver, and is used to align the audio samples from the digital signal with audio samples from the analog signal with a granularity of audio samples. Accordingly, the value of the fine delay will also be implementation specific and may be different for AM and FM modes.

Once the alignment module 609 determines the delay amount, the coarse pre-decode delay 610A and fine delay 610B are inserted, respectively, into the audio blend delay output buffer 616 and the fine delay buffer 617 by adjusting read pointers in the buffers by the respective delay amount. The delay amount in samples can be positive or negative up to the size of a full audio frame (e.g., 2048 samples). The delayed audio samples 631 from the digital signal path 601 are then outputted to the audio transition module 603 as digital audio frames.

The samples from the analog portion of the signal exit the split module 606 and enter an analog preprocessing circuit 622 that performs initial processing of the samples (e.g., sample buffering and noise filtering). The samples then enter an analog demodulator 624 where they are demodulated into analog audio samples. Next, the analog audio samples enter an asynchronous sample rate converter (SRC) where the sample rate of the analog audio samples based on the receiver's reference clock is adjusted to match the transmitter's reference clock as obtained from the digital demodulator 612. The analog audio samples then pass through an analog sample buffer 628 where the analog audio samples may be framed into analog audio frames of, for example, 1024 or 2048 audio stereo samples, and are then inputted as audio samples 632 from the analog signal path 602 into the audio transition module 603.

At the audio transition module 603, the decompressed digital audio samples in the audio blend delay output buffer 616 and fine delay buffer 617 are combined with the analog audio samples under control of a transition control signal 633 generated by a blend function module 619. This transition control signal controls the relative amounts of the analog and digital portions of the signal that are used to form the output by ramping the digital audio up or down. The audio transition module 603 then outputs the digitally combined signal to the DAC 450, where it is converted into analog audio for rendering.

Typically, the transition control signal 633 is responsive to some measurement of degradation of the digital portion of the signal, such as a signal-to-noise ratio or digital carrier to noise density ratio Cd/No, which is used to make switching from analog to digital audio more conservative. In a channel with generally low Cd/No, the switching will be disallowed even if the audio quality indicators are good enough to warrant a temporary switch to digital, thereby avoiding multiple blends at the digital edge of coverage. However, the estimated digital carrier/signal-to-noise ratio Cd/No provides only an approximate indication of the channel quality. In the fading channels or channels with interference, inaccuracies in the estimated Cd/No values may result in an overly conservative decision that would prolong staying in analog, thus reducing the digital coverage. Accordingly, the blend function module 619 may process digital audio quality indicators (QI) estimated in the process of audio decoding. To this end, an audio QI estimator 618 may be connected to parse and check the audio packets for data corruption as the audio samples are stored in the audio blend delay output buffer 616, thereby enabling the blend function module 619 to determine if the digital audio samples stored in the audio blend delay buffer 616 are "good" audio. In this way, the blend function module 619 can ensure that the analog audio will be blending to an undistorted digital audio by generating the transition control signal 633 to control when the cross-over between analog and digital audio should start.

Positioned at the output of the audio decoder 615, the audio blend delay output buffer 616 is implemented in the (decompressed) PCM domain. Given a typical blend transition duration (e.g., approximately 1 second) for ensuring smooth transition between analog and digital audio, the audio blend delay output buffer 616 should be sized to hold sufficient data for this duration (e.g., at least approximately 170 kB). Unfortunately, such large buffers are prohibitively large and expensive for the chips with limited on-chip memory.

Figure 12:
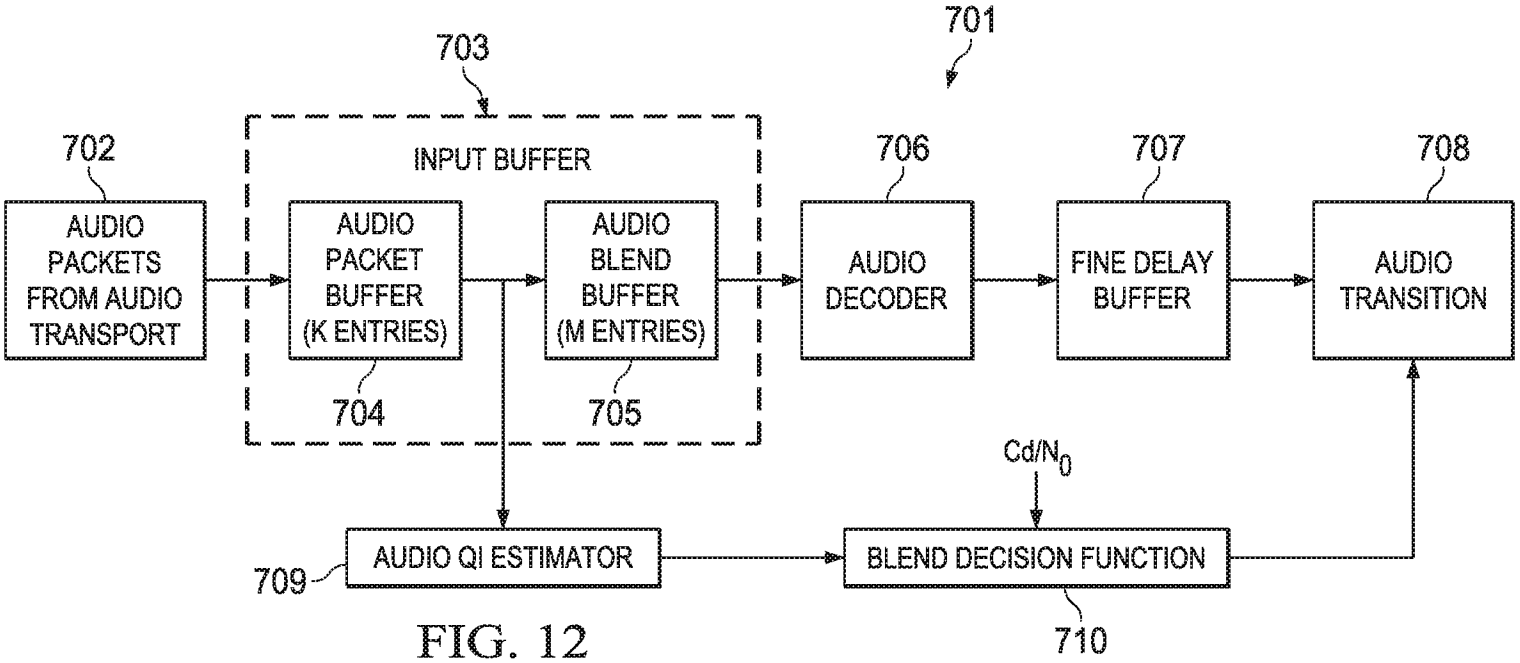
FIG. 12 illustrates a circuit block diagram of a first digital signal path in accordance with selected embodiments.

To provide illustrative details of a digital radio receiver having a compact and efficient audio blend delay buffer, reference is now made to FIG. 12 which illustrates a functional circuit block diagram of a first digital signal path 701 in accordance with selected embodiments of the present disclosure. The illustrated functions can be performed in the baseband processor (e.g., 447 in FIG. 8) which embodies a processing system that may include one or more processing units that are suitably configured and coupled to any memory (e.g., RAM, Flash ROM, ROM) to implement the depicted digital signal path functions. For example, the baseband processor may include an audio transport module which performs upper layer decoding of audio and data signals to generate compressed audio packets 702 for the main and supplemental programs which are stored in the input buffer or memory storage device 703 which holds at least K entries. In particular, the input buffer or memory storage device 703 may include a first audio packet buffer 704 for storing K compressed packet entries and a second audio blend buffer 705 for storing M compressed packet entries. The second audio blend buffer 705 may be any suitable memory, such as a first-in-first-out (FIFO) implemented in RAM. In selected embodiments, the size of the second audio blend buffer 705 holds M compressed packet entries, where M is typically less than K and is chosen such that it corresponds to a certain duration of audio, for example, 1 second. In this way, the compressed audio packets from each modem frame are stored in the buffer or memory storage device 703 and processed by an audio decoder 706 to produce PCM audio samples for output to the fine delay buffer 707 which is used for accurate time alignment of the digital audio samples with analog audio samples at the audio transition module 708. By moving the audio blend buffer 705 to the input of the audio decoder 706, the size of the audio blend buffer 705 may be drastically reduced by virtue of storing compressed audio packets. For example, to store 1 second of audio at 96 kb/s, the audio blend buffer 705 requires only 12 kB of memory which is almost 15 fold reduction as compared to the audio blend delay output buffer 616.

To measure the signal quality of the audio packets received from the audio transport and stored in the audio blend input buffer 705, the audio QI estimator 709 may be connected to parse and check the compressed audio packets for data corruption as they are stored in the audio blend delay input buffer 705, thereby enabling the blend decision function module 710 to determine if the digital audio samples stored in the audio blend delay buffer 705 are "good" audio. To do that, the audio quality estimation is done ahead of the audio decoding block 706. In selected embodiments, the audio QI estimator 709 generates estimated digital audio quality indicators (QI) prior to audio decoding by parsing and checking the compressed audio packets for data corruption as the compressed packets are stored in the audio blend delay input buffer 705, such as by using a cyclic redundancy check (CRC) or polynomial code checksum function. In addition or in the alternative, the audio QI estimator 709 may use consistency check of packet header information bits designed to guide the audio decoding process. The check results lead to identification of the need and/or state of an error concealment process that is performed by the audio decoding block 706. Such identification will directly result in a corresponding decoding strategy, and therefore determine the quality of the audio output this strategy produces. This quality is quantified and represented by the digital audio quality indicators (QI) generated by the audio QI estimator 709. By computing estimated audio QI values from the compressed audio packets as they are stored in the audio blend delay input buffer 705, the audio quality estimation precedes the audio decoding by the specified blend transition duration (e.g., approximately 1 second). In addition, the "pre-computed" audio QI values from the estimator 709 are available for processing by the blend decision function module 710 which controls the start of the cross-over between analog and digital audio at the audio transition module 708. In selected embodiments, the blend decision function module 710 processes one audio QI value at a time, such as by using state machine control logic which changes state with each arriving indicator. As a result of this sequential processing of audio QI values, the blend decision function module 710 has no advance knowledge of the next audio QI value, and the blend decision is made based on the packets processed up to a present time with no look ahead capability.

Figure 13:
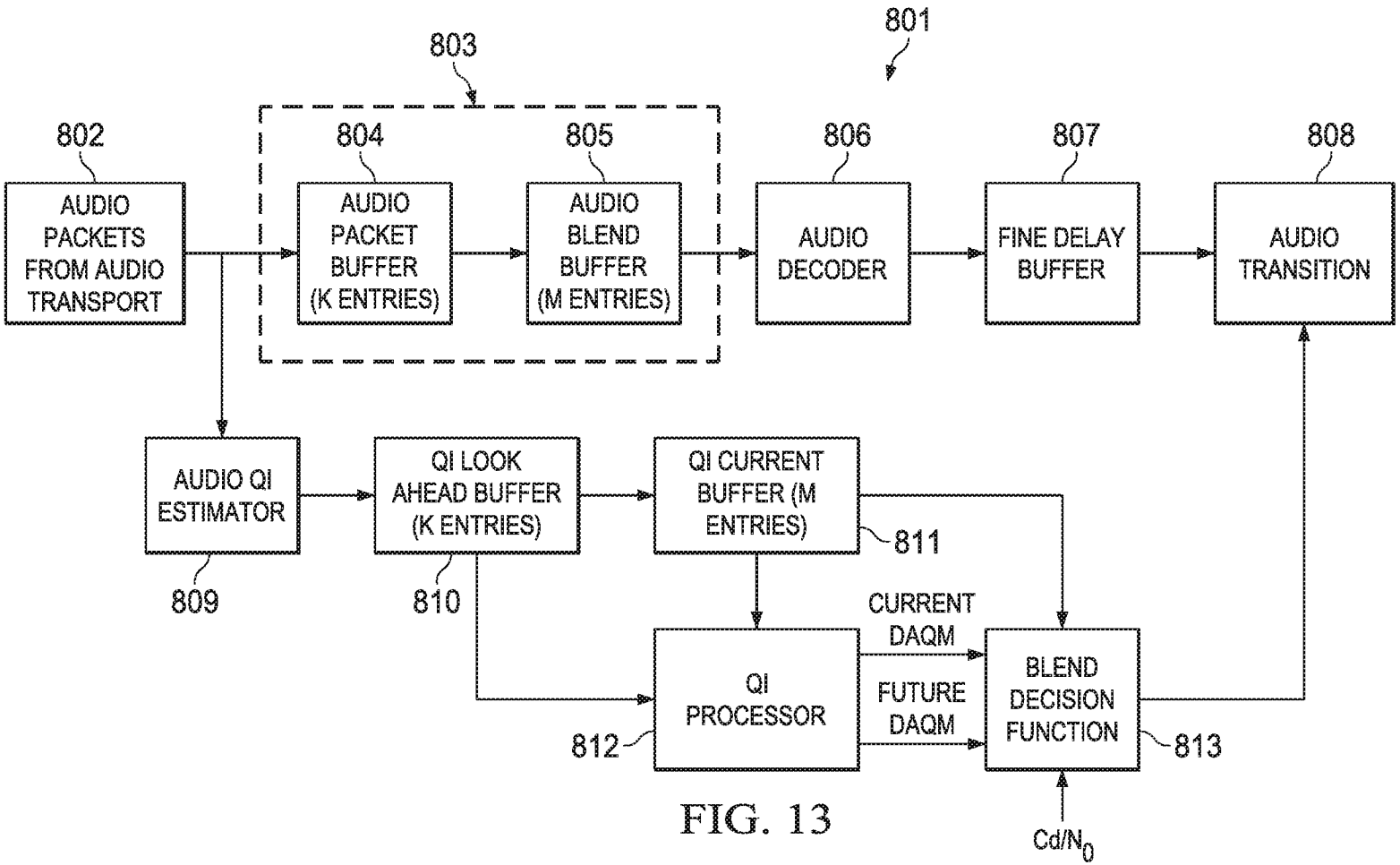
FIG. 13 illustrates a circuit block diagram of a second digital signal path in accordance with selected embodiments.
Figure 14:
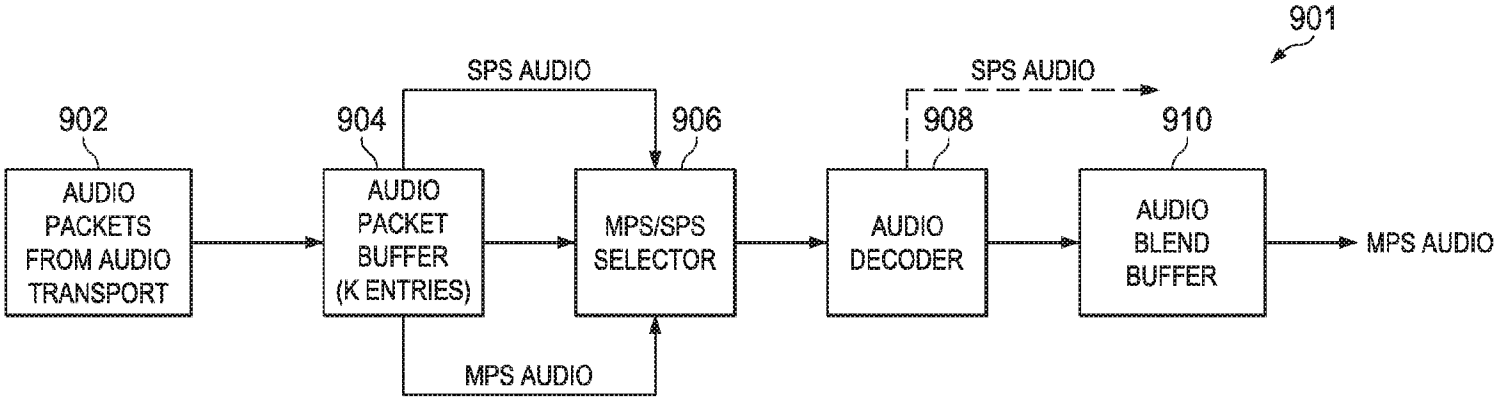
FIG. 14 illustrates a circuit block diagram of a third digital signal path employing a conventional SPS/MPS switching architecture.

To provide illustrative details of a digital radio receiver which uses a compact and efficient audio blend delay buffer to provide an improved blend decision function, reference is now made to FIG. 13 which illustrates a functional circuit block diagram of a second digital signal path 801 in accordance with selected embodiments of the present disclosure. The illustrated functions can be performed in the baseband processor (e.g., 447 in FIG. 8) which embodies a processing system that may include one or more processing units that are suitably configured and coupled to any memory to implement the depicted digital signal path functions. For example, the baseband processor may include an audio transport module for performing upper layer decoding of audio and data signals to generate compressed audio packets 802 for the main and supplemental programs which are stored in the input buffer or memory storage device 803 which holds at least K entries. In particular, the input buffer or memory storage device 803 may include a first K-entry audio packet buffer 804 for storing compressed packets and a second, M-entry audio blend buffer 805 for storing compressed packets. The second audio blend buffer 805 may be any suitable memory, such as a first-in-first-out (FIFO) implemented in RAM, which may be sized to store M compressed packet entries such that the size of the audio blend buffer 805 is drastically reduced by virtue of storing compressed audio packets. In this way, the compressed audio packets from each modem frame are stored in the buffer or memory storage device 803 and processed by an audio decoder 806 to produce PCM audio samples for output to the fine delay buffer 807.

With K+M compressed audio packets stored in the input buffer/memory storage device 803, the digital signal path 801 measures the signal quality of the audio packets by connecting an audio QI estimator 809 to parse and check the compressed audio packets received from the audio transport 802 as they are stored in the input buffer/memory storage device 803. In selected embodiments, the audio QI estimator 809 generates estimated audio quality indicators (QI) by parsing and checking the compressed audio packets for data corruption as they are stored in the audio packet buffer 804, such as by using CRC, polynomial code checksum, and/or consistency check functions to identify audio packet errors. However, the audio quality estimation is advanced further in time (as compared to the digital signal path 701 shown in FIG. 12) by connecting the audio QI estimator 809 to parse and check the audio packets extracted from the audio transport 802. However, instead of providing the estimated audio QI values as direct inputs to the blend decision function module 813, the QI look ahead buffer 810 is connected to the output of the audio QI estimator 809 so that each audio packet stored in the audio packet buffer 804 has a corresponding assigned audio QI value stored in the QI look ahead buffer 810. In addition, a QI current buffer 811 may be connected to the output of the QI look ahead buffer 810 so that each audio packet stored in the audio blend buffer 805 has a corresponding assigned audio QI value stored in the QI current buffer 811.

In selected embodiments, the QI look ahead buffer 810 is sized to store K entries corresponding to the K entries stored in the audio packet buffer 804, and the QI current buffer 811 is sized to store M entries corresponding to the M entries stored in the audio blend buffer 805. For example, if the audio packet buffer 804 stores compressed audio packets for approximately 1.5 seconds of audio for the FM main program and the audio blend buffer 805 stores compressed audio packets for approximately 1 second of audio for the FM main program, the QI look ahead buffer 810 provides the blend decision function module 813 the ability to look 1.5 seconds ahead for the corresponding estimated audio QI values when making a decision to blend. Without the QI look ahead buffer 810, the blend decision function module 813 would only have access to the last M packets (corresponding to the size of the audio blend buffer 805) when making the blend decision. This can result in a situation where a decision to blend to digital is made based on the last M packets being "good," but if the next packet is "bad," this could result in blending back to analog. Thus, the QI look ahead buffer 810 enables the blend decision function module 813 to predict the audio quality of the next several audio packets, thereby avoiding blending back and forth.

In accordance with selected embodiments of the present disclosure, the blend decision function module 813 uses both the current audio QI values and the look ahead QI values to guide the blending process. To this end, a QI processing circuit or module 812 may be connected to receive audio QI values from the QI look ahead buffer 810 which corresponds to the compressed audio packets in the audio packet buffer 804, and may also be connected to receive audio QI values from the QI current buffer 811 which corresponds to the compressed audio packets in the audio blend buffer 805. The calculation functionality of the QI processor 812 may be embodied in control logic, filters, and/or other suitable circuitry for calculating current and/or future audio quality metric values. For example, the QI processor 812 may be configured to calculate digital audio quality metrics (DAQM) for both current and future packets, where a current DAQM value is the result of processing current audio QI values corresponding to the current M packets, and where a future DAQM value is the result of processing look ahead audio QI values corresponding to K packets that will be decoded after decoding the current M packets. As a result, the QI processor 812 may generate a current DAQM value indicating that the current M packets are "good" and a future DAQM value indicating the presence of bad packets in the future K packets. Using the "good" current DAQM values and the "bad" future DAQM value, the blend decision function module 813 may be configured to refrain from blending to digital. In selected embodiments, the DAQM values can be retrieved and further processed by the host microcontroller to reduce the temporal value fluctuations, where the host microcontroller makes its own blend decisions which may be more or less conservative than the blend decision function module 813.

To preserve backward compatibility with the existing digital radio receivers in terms of the way blend decision is made, the current DAQM and future DAQM calculation can be turned off by disabling QI processor 812 and by routing the estimated current audio QI values for direct input to the blend decision function module 813. With the QI processor disabled, the blend decision function module 813 may be configured to use only the current audio QI values, alone or in combination with estimated digital carrier/signal-to-noise ratio values Cd/No. In either configuration, the blend decision function module 813 is able to use the digital audio stored in the input buffer/memory storage device 803 to control the start of the cross-over between analog and digital audio at the audio transition module 808.

In addition to reducing the audio blend buffer memory size and improving the blending decision based on look ahead audio QI values, it will be appreciated that there are other attendant benefits and advantages of moving the audio blend buffer in front of the audio decoder. To illustrate one such benefit, reference is now made to FIG. 14 which illustrates a circuit block diagram of a third digital signal path 901 which employs a conventional SPS/MPS switching architecture. In the illustrated portion of the digital signal path 901, compressed audio packets for the main and supplemental programs extracted by the audio transport 902 are stored in the K-entry audio packet buffer 904. At the output of the audio packet buffer 904, a selector switch 906 is connected to connect either MPS or SPS compressed audio packets to the audio decoder 908 which produces therefrom PCM audio samples for output and storage in the audio blend buffer 910. If the user selects "SPS audio," the MPS/SPS selector switch 906 routes SPS audio packets to the input of the audio decoder 908. Likewise, if the user selects "MPS audio." the MPS/SPS selector switch 906 feeds MPS audio packets into the audio decoder 908. The audio decoder 908 outputs PCM samples which represent either MPS or SPS audio. The path of the samples is different depending on which audio is selected. In particular, SPS audio goes directly to the output (as shown by the dashed line), but MPS audio goes through the audio blend buffer 910 and then to the audio transition module (not shown). Because of the size and positioning of the audio blend buffer 910 at the output of the audio decoder 908, any switching to MPS audio requires a "fill" time (e.g., 1 second) before the MPS audio is available at the output of the audio blend buffer 910, during which time the user will hear silence.

Figure 15:
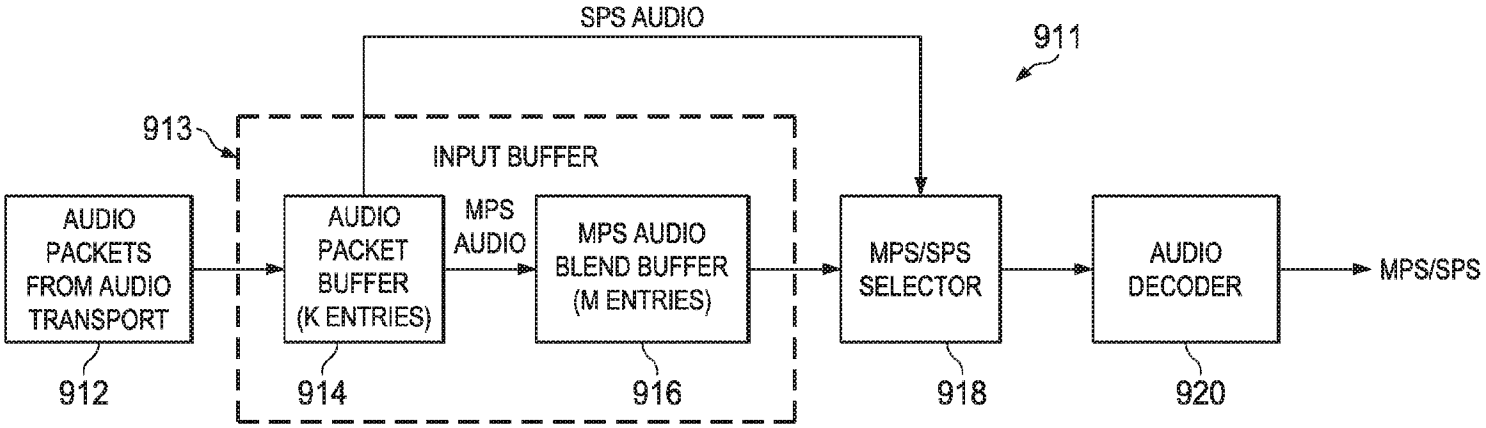
FIG. 15 illustrates a circuit block diagram of a fourth digital signal path employing a SPS/MPS switching architecture in accordance with selected embodiments.

In contrast, FIG. 15 illustrates a circuit block diagram of a fourth digital signal path 911 which employs a SPS/MPS switching architecture in accordance with selected embodiments where the audio blend buffer is positioned in front of the audio decoder. In the illustrated portion of the digital signal path 911, compressed audio packets for the main and supplemental programs extracted by the audio transport 912 are stored in the input buffer or memory storage device 913 which holds at least K entries. In particular, the input buffer or memory storage device 913 includes a first audio packet buffer 914 for storing K compressed packet entries and a second MPS audio blend buffer 916 for storing M compressed packet entries. At the output of the MPS audio blend buffer 916, a selector switch 918 is connected to connect either MPS or SPS compressed audio packets to the audio decoder 920 which produces therefrom either MPS or SPS PCM audio samples for output. If the user selects "SPS audio," the MPS/SPS selector switch 906 routes SPS audio packets from the audio packet buffer 914 to the input of the audio decoder 920. However, if the user selects "MPS audio," the MPS/SPS selector switch 918 feeds MPS audio packets from the output of the audio blend buffer 916. As a result, when the switch from SPS to MPS occurs, the MPS audio is already available from the audio blend buffer 916 so that the switching is almost instantaneous and there is no switching-related silence after the switch. The output path for both MPS and SPS audio from the audio decoder 920 is the same in this case.

As will be appreciated, the disclosed system, method and receiver apparatus for processing a composite digital audio broadcast signal and programmed functionality disclosed herein may be embodied in hardware, processing circuitry, software (including but is not limited to firmware, resident software, microcode, etc.), or in some combination thereof, including a computer program product accessible from a computer-usable or computer-readable medium providing program code, executable instructions, and/or data for use by or in connection with a computer or any instruction execution system, where a computer-usable or computer readable medium can be any apparatus that may include or store the program for use by or in connection with the instruction execution system, apparatus, or device. Examples of a non-transitory computer-readable medium include a semiconductor or solid state memory, magnetic tape, memory card, a removable computer diskette, a random access memory (RAM), a read-only memory (ROM), a rigid magnetic disk and an optical disk, such as a compact disk-read only memory (CD-ROM), compact disk-read/write (CD-R/W) and DVD, or any other suitable memory.

By now it should be appreciated that there is provided herein a receiver for an in-band on-channel (IBOC) digital radio broadcast signal and associated processor-implemented method of operation. In selected embodiments, a digital radio broadcast receiver includes at least one recordable storage medium having stored thereon executable instructions and data which, when executed by at least one processing device, cause the at least one processing device to separate a received composite digital radio broadcast signal into an analog audio portion and a digital audio portion; demodulate the analog and digital audio portions to produce, respectively, analog and digital audio signal samples; and digitally combine the analog audio signal samples with the digital audio signal samples to produce an audio output by preventing or delaying blending from analog to digital when indicated by one or more corresponding digital audio quality indicator values. As disclosed herein, the demodulation of the digital audio portion comprises demodulating the digital audio portion of the composite digital radio broadcast signal to produce a digital audio signal, such as by performing deinterleaving, code combining, FEC decoding, and error flagging on the digital audio portion of the composite digital radio broadcast signal to produce a baseband digital signal. The digital audio signal is then decoded using an upper layer decoding process to compute a plurality compressed audio packets, such as by performing audio transport decoding of the digital baseband signal to compute the plurality compressed audio packets. Each compressed audio packet is then processed to compute a corresponding digital audio quality indicator value, such as by parsing and checking each compressed audio packet for data corruption and/or performing a consistency check for each header on each compressed audio packet. In addition, each compressed audio packet is stored in an input buffer which is connected to provide compressed audio packets for input to an audio decoder and which may include an audio packet buffer for storing K look ahead compressed audio packets, and an audio blend buffer for storing M current compressed audio packets. In selected embodiments, each compressed audio packet stored in the audio blend buffer is simultaneously processed to compute the corresponding digital audio quality indicator value, while in other embodiments, each compressed audio packet stored in the audio packet buffer is processed to compute a corresponding digital audio quality indicator value before storing said compressed audio packet in the audio blend buffer so that each compressed audio packet is stored in the audio blend buffer after being processed to compute the corresponding digital audio quality indicator value. After storing each compressed audio packet in an audio blend buffer for storing a plurality of compressed audio packets, audio information from each compressed audio packet stored in the audio blend buffer is processed with an audio decoder to generate decompressed digital audio signal samples. In selected embodiments where SPS audio packets are stored in an audio packet buffer and MPS audio packets are stored in the audio blend buffer, a selector switch may be connected at an input of the audio decoder for switching between SPS audio packets and MPS audio packets for input into the audio decoder. In selected embodiments, each digital audio quality indicator value is stored in a memory storage device which may include a look ahead buffer for storing K look ahead digital audio quality indicator values corresponding to K compressed audio packets stored in an audio packet buffer, and a current buffer for storing M current digital audio quality indicator values corresponding to the plurality of compressed audio packets stored in the audio blend buffer. In such embodiments, a quality indicator processing module may be provided for calculating future digital audio quality metric based on the K look ahead quality indicator values, and for calculating a current digital audio quality metric based on the M quality indicator values, where the step of digitally combining the analog audio signal samples with the digital audio signal samples prevents ore delays blending from analog to digital when a current digital audio quality metric has a first value indicating that the compressed audio packets stored in the audio blend buffer are undistorted and a future digital audio quality metric has a second value indicating that future compressed audio packets are distorted.

Although the described exemplary embodiments disclosed herein are directed to an exemplary IBOC system for digitally combining the analog audio signal samples with the digital audio signal samples in an in-band on-channel (IBOC) digital radio broadcast signal by employing digital audio quality indicator values extracted from compressed audio packets before audio decoding thereof, the present invention is not necessarily limited to the example embodiments which illustrate inventive aspects of the present invention that are applicable to a wide variety of digital radio broadcast receiver designs and/or operations. Thus, the particular embodiments disclosed above are illustrative only and should not be taken as limitations upon the present invention, as the invention may be modified and practiced in different but equivalent manners apparent to those skilled in the art having the benefit of the teachings herein. Accordingly, the foregoing description is not intended to limit the invention to the particular form set forth, but on the contrary, is intended to cover such alternatives, modifications and equivalents as may be included within the spirit and scope of the invention as defined by the appended claims so that those skilled in the art should understand that they can make various changes, substitutions and alterations without departing from the spirit and scope of the invention in its broadest form.

What is claimed is:

1. A method for processing a composite digital radio broadcast signal to smooth signal blending, comprising:

separating a received composite digital radio broadcast signal into an analog audio portion and a digital audio portion;

demodulating the analog audio portion of the composite digital radio broadcast signal to produce analog audio signal samples;

demodulating the digital audio portion of the composite digital radio broadcast signal to produce digital audio signal samples by:

demodulating the digital audio portion of the composite digital radio broadcast signal to produce a digital audio signal, decoding the digital audio signal using an upper layer decoding process to compute a plurality of compressed audio packets, processing each compressed audio packet in the compressed audio domain to compute a corresponding digital audio quality indicator value prior to performing audio decoding on said compressed audio packet, storing each compressed audio packet in an audio blend buffer for storing a plurality of compressed audio packets, and performing audio decoding on audio information from each compressed audio packet stored in the audio blend buffer with an audio decoder which is connected to an output of the audio blend buffer to generate decompressed digital audio signal samples; and digitally combining the analog audio signal samples with the digital audio signal samples to produce an audio output by preventing or delaying blending from analog to digital when indicated by one or more corresponding digital audio quality indicator values.

2. The method of claim 1, where the composite digital radio broadcast signal comprises an over-the-air in-band on-channel digital radio broadcast signal.

3. The method of claim 1, where demodulating the digital audio portion of the composite digital radio broadcast signal to produce a digital audio signal comprises performing deinterleaving, code combining, forward error correction (FEC) decoding, and error flagging on the digital audio portion of the composite digital radio broadcast signal to produce a baseband digital signal.

4. The method of claim 3, where decoding the digital audio signal comprises performing audio transport decoding of the digital baseband signal to compute the plurality of compressed audio packets.

5. The method of claim 1, where processing each compressed audio packet to compute the corresponding digital audio quality indicator value comprises parsing and checking each compressed audio packet for data corruption.

6. The method of claim 1, where processing each compressed audio packet to compute the corresponding digital audio quality indicator value comprises performing a consistency check for each header on each compressed audio packet.

7. The method of claim 1, where each compressed audio packet stored in the audio blend buffer is simultaneously processed to compute the corresponding digital audio quality indicator value.

8. The method of claim 1, where each compressed audio packet is stored in the audio blend buffer after being processed to compute the corresponding digital audio quality indicator value.

9. The method of claim 8, further comprising storing the corresponding digital audio quality indicator value in a memory storage device comprising:

a look ahead buffer for storing K look ahead digital audio quality indicator values corresponding to K compressed audio packets stored in an audio packet buffer; and a current buffer for storing M current digital audio quality indicator values corresponding to the plurality of compressed audio packets stored in the audio blend buffer.

10. The method of claim 9, further comprising:

calculating a future digital audio quality metric based on the K look ahead quality indicator values, and calculating a current digital audio quality metric based on the M quality indicator values, where digitally combining the analog audio signal samples with the digital audio signal samples comprises preventing or delaying blending from analog to digital when a current digital audio quality metric has a first value indicating that the compressed audio packets stored in the audio blend buffer are undistorted and a future digital audio quality metric has a second value indicating that future compressed audio packets are distorted.

11. The method of claim 1, further comprising:

storing supplemental program service (SPS) audio packets in an audio packet buffer; and storing main program service (MPS) audio packets in the audio blend buffer, where demodulating the digital audio portion further comprises switching between SPS audio packets and MPS audio packets for input into the audio decoder.

12. A receiver for processing a composite digital radio broadcast signal comprising at least one recordable storage medium having stored thereon executable instructions and data which, when executed by at least one processing device, cause the at least one processing device to demodulate a digital audio portion of the composite digital radio broadcast signal to produce digital audio signal samples by:

demodulating the digital audio portion of the composite digital radio broadcast signal to produce a digital audio signal, decoding the digital audio signal using an upper layer decoding process to compute a plurality of compressed audio packets, processing each compressed audio packet to compute a corresponding digital audio quality indicator value prior to performing audio decoding on said compressed audio packet, storing each compressed audio packet in an input buffer which is connected to provide compressed audio packets for input to an audio decoder, and performing audio decoding on audio information from each compressed audio packet stored in the input buffer with the audio decoder which generates decompressed digital audio signal samples.

13. The receiver of claim 12, further comprising:

a digital demodulator for demodulating the digital audio portion of the composite digital radio broadcast signal to produce the digital audio signal, an audio transport decoder for decoding the digital audio signal using the upper layer decoding process to compute the plurality compressed audio packets, an audio estimator for processing each compressed audio packet to compute the corresponding digital audio quality indicator value, an audio blend buffer in the input buffer for storing each compressed audio packet, and an audio decoder connected to an output of the audio blend buffer for processing audio information from each compressed audio packet stored in the audio blend buffer to generate decompressed digital audio signal samples.

14. The receiver of claim 12, where the executable instructions and data cause the at least one processing device to process each compressed audio packet to compute a corresponding digital audio quality indicator value by performing a consistency check for each header on each compressed audio packet stored in the input buffer or parsing each compressed audio packet stored in the input buffer to check for data corruption.

15. The receiver of claim 12, where the input buffer comprises an audio packet buffer connected to an audio blend buffer, and where the executable instructions and data cause the at least one processing device to store each compressed audio packet in the audio blend buffer while simultaneously processing each compressed audio packet to compute a corresponding digital audio quality indicator value.

16. The receiver of claim 12, where the input buffer comprises an audio packet buffer connected to an audio blend buffer, and where the executable instructions and data cause the at least one processing device to process each compressed audio packet stored in the audio packet buffer to compute a corresponding digital audio quality indicator value before storing said compressed audio packet in the audio blend buffer.

17. The receiver of claim 16, further comprising:

a look ahead buffer for storing K look ahead digital audio quality indicator values corresponding to K compressed audio packets stored in the audio packet buffer; and a current buffer for storing M current digital audio quality indicator values corresponding to the plurality of compressed audio packets stored in the audio blend buffer.

18. The receiver of claim 17, further comprising a quality indicator processing module for calculating a future digital audio quality metric based on the K look ahead quality indicator values to indicate whether indicating future compressed audio packets are distorted, and for calculating a current digital audio quality metric based on the M quality indicator values to indicate whether the compressed audio packets stored in the audio blend buffer are undistorted.

19. The receiver of claim 12, further comprising a selector switch connected at an input of the audio decoder for switching between (1) supplemental program service (SPS) audio packets stored in an audio packet buffer of the input buffer and (2) main program service (MPS) audio packets stored in an audio blend buffer of the input buffer.

20. A tangible non-transitory computer readable medium comprising computer program instructions adapted to cause a baseband processing system to:

demodulate a digital audio portion of a composite digital radio broadcast signal to produce a digital audio signal;

decode the digital audio signal using an upper layer decoding process to compute a plurality of compressed audio packets;

store each compressed audio packet in an input buffer which is connected to provide compressed audio packets for input to an audio decoder, where the input buffer comprises:

an audio packet buffer for storing K look ahead compressed audio packets, and an audio blend buffer for storing M current compressed audio packets;

process each compressed audio packet to compute a corresponding digital audio quality indicator value prior to performing audio decoding on said compressed audio packet; and perform audio decoding on audio information from each compressed audio packet stored in the input buffer with the audio decoder which generates decompressed digital audio signal samples.

* * * * *